US012091801B2

(12) United States Patent
Jones et al.

(10) Patent No.: US 12,091,801 B2
(45) Date of Patent: Sep. 17, 2024

(54) APPARATUS AND METHOD FOR TREATING A SUBSTRATE WITH SOLID PARTICLES

(71) Applicant: Xeros Limited, Rotherham (GB)

(72) Inventors: Gareth Evan Lyn Jones, Bath and North East (GB); Christopher Holden, Bath and North East (GB); David Stevens, Bath and North East (GB)

(73) Assignee: Xeros Limited, Rotherham (GB)

( * ) Notice: Subject to any disclaimer, the term of this patent is extended or adjusted under 35 U.S.C. 154(b) by 753 days.

(21) Appl. No.: 17/258,406

(22) PCT Filed: Jul. 12, 2019

(86) PCT No.: PCT/EP2019/068911
§ 371 (c)(1),
(2) Date: Jan. 6, 2021

(87) PCT Pub. No.: WO2020/012026
PCT Pub. Date: Jan. 16, 2020

(65) Prior Publication Data

US 2021/0269961 A1 Sep. 2, 2021

(30) Foreign Application Priority Data

Jul. 13, 2018 (GB) ..... 1811569

(51) Int. Cl.
*D06F 35/00* (2006.01)
*D06F 21/02* (2006.01)
(Continued)

(52) U.S. Cl.
CPC ..... *D06F 35/006* (2013.01); *D06F 21/02* (2013.01); *D06F 37/06* (2013.01); *D06M 23/08* (2013.01)

(58) Field of Classification Search
None
See application file for complete search history.

(56) References Cited

U.S. PATENT DOCUMENTS 8,959,961 B2 2/2015 Jenkins et al.
8,974,545 B2 3/2015 Burkinshaw et al.
(Continued)

FOREIGN PATENT DOCUMENTS

CN 102061588 A 5/2011
CN 102061589 A 5/2011
(Continued)

OTHER PUBLICATIONS

U.S. Appl. No. 17/258,396, Xeros Ltd.
(Continued)

*Primary Examiner* — Spencer E. Bell
(74) *Attorney, Agent, or Firm* — Clark & Elbing LLP

(57) ABSTRACT

An apparatus, method and kit for use in the treatment of substrates with a solid particulate material, said apparatus comprising a housing having mounted therein a rotatably mounted drum having an inner surface and an end wall and access means for introducing said substrates into said drum, the drum preferably having and elongate protrusion (1) located on said inner surface of said drum, wherein •(a) said drum comprises storage means for storage of said solid particulate material; and •(b) said drum comprises a first collecting flow path to facilitate flow of said solid particulate material from the interior of said drum to said storage means when said drum rotates in a first collecting direction, characterised in that said drum comprises a second collecting flow path to facilitate flow of said solid particulate material from the interior of said drum to said storage means when said drum rotates in a second collecting direction, wherein said second collecting direction is in the opposite rotational direction to said first collecting direction, and wherein said first collecting flow path and said second collecting flow path are different flow paths.

44 Claims, 13 Drawing Sheets

(51) Int. Cl.
*D06F 37/06* (2006.01)
*D06M 23/08* (2006.01)

(56) References Cited

U.S. PATENT DOCUMENTS

| | | | |
|---|---|---|---|
| 9,017,423 | B2 | 4/2015 | Burkinshaw et al. |
| 9,121,000 | B2 | 9/2015 | Burkinshaw et al. |
| 9,127,882 | B2 | 9/2015 | Jenkins et al. |
| 9,297,107 | B2 | 3/2016 | Jenkins |
| 9,315,766 | B2 | 4/2016 | He et al. |
| 9,404,210 | B2 | 8/2016 | He et al. |
| 9,410,278 | B2 | 8/2016 | He et al. |
| 9,476,155 | B2 | 10/2016 | He et al. |
| 9,487,898 | B2 | 11/2016 | He et al. |
| 9,523,169 | B2 | 12/2016 | Sawford et al. |
| 9,550,966 | B2 | 1/2017 | Burkinshaw et al. |
| 9,587,337 | B2 | 3/2017 | He et al. |
| 9,587,340 | B2 | 3/2017 | Jenkins et al. |
| 9,631,314 | B2 | 4/2017 | Yin et al. |
| 9,803,307 | B2 | 10/2017 | Jenkins et al. |
| 9,834,881 | B2 | 12/2017 | Sawford et al. |
| 9,845,516 | B2 | 12/2017 | Steele |
| 9,850,455 | B2 | 12/2017 | Jenkins et al. |
| 9,850,619 | B2 | 12/2017 | Wells et al. |
| 9,914,901 | B2 | 3/2018 | Burkinshaw et al. |
| 9,932,700 | B2 | 4/2018 | Wells et al. |
| 10,017,895 | B2 | 7/2018 | Wells et al. |
| 10,081,900 | B2 | 9/2018 | Wells et al. |
| 10,287,642 | B2 | 5/2019 | Scott |
| 10,301,691 | B2 | 5/2019 | Feyisa et al. |
| 10,316,448 | B2 | 6/2019 | He et al. |
| 10,494,590 | B2 | 12/2019 | Abercrombie et al. |
| 10,590,499 | B2 | 3/2020 | Ashfaq et al. |
| 10,597,814 | B2 | 3/2020 | Wells et al. |
| 10,745,769 | B2 | 8/2020 | Steele |
| 10,773,976 | B2 | 9/2020 | Scott et al. |
| 10,781,404 | B2 | 9/2020 | Bird et al. |
| 10,808,289 | B2 | 10/2020 | Sadeghi |
| 2011/0296628 | A1 | 12/2011 | Jenkins et al. |
| 2012/0048299 | A1 | 3/2012 | Jenkins et al. |
| 2013/0167882 | A1 | 7/2013 | Burkinshaw et al. |
| 2014/0201929 | A1 | 7/2014 | He et al. |
| 2014/0230160 | A1 | 8/2014 | He et al. |
| 2014/0283314 | A1 | 9/2014 | He et al. |
| 2014/0317860 | A1 | 10/2014 | He et al. |
| 2015/0027173 | A1 | 1/2015 | Wu et al. |
| 2015/0096128 | A1 | 4/2015 | Sawford et al. |
| 2015/0096129 | A1 | 4/2015 | Sawford et al. |
| 2015/0175945 | A1 | 6/2015 | Waddon et al. |
| 2015/0252511 | A1 | 9/2015 | Roberts et al. |
| 2016/0122936 | A1* | 5/2016 | Wells ..... D06F 58/02 34/108 |
| 2016/0195409 | A1 | 7/2016 | Goldberg et al. |
| 2016/0197998 | A1 | 7/2016 | Carleo |
| 2016/0251602 | A1 | 9/2016 | Steele et al. |
| 2016/0251603 | A1 | 9/2016 | Steele et al. |
| 2017/0051447 | A1 | 2/2017 | He et al. |
| 2017/0159222 | A1 | 6/2017 | Jenkins et al. |
| 2017/0241061 | A1 | 8/2017 | Wells et al. |
| 2017/0247771 | A1 | 8/2017 | Scott |
| 2018/0057777 | A1 | 3/2018 | Waddon et al. |
| 2018/0134994 | A1 | 5/2018 | Steele et al. |
| 2018/0141089 | A1 | 5/2018 | Sawford et al. |
| 2018/0216049 | A1 | 8/2018 | Bird et al. |
| 2019/0211288 | A1 | 7/2019 | Potts et al. |
| 2019/0233760 | A1 | 8/2019 | Lavery et al. |
| 2020/0002650 | A1 | 1/2020 | Servin et al. |
| 2020/0316501 | A1 | 10/2020 | Jones |
| 2020/0378054 | A1 | 12/2020 | Cobb et al. |
| 2022/0259790 | A1 | 8/2022 | Jones et al. |
| 2022/0298712 | A1 | 9/2022 | Mattley et al. |

FOREIGN PATENT DOCUMENTS

| | | | |
|---|---|---|---|
| CN | 202175862 | U | 3/2012 |
| CN | 102425053 | A | 4/2012 |
| CN | 102425055 | A | 4/2012 |
| CN | 202214631 | U | 5/2012 |
| CN | 202214633 | U | 5/2012 |
| CN | 202298219 | U | 7/2012 |
| CN | 202298220 | U | 7/2012 |
| CN | 202298222 | U | 7/2012 |
| CN | 202323458 | U | 7/2012 |
| CN | 202359387 | U | 8/2012 |
| CN | 202359388 | U | 8/2012 |
| CN | 202359389 | U | 8/2012 |
| CN | 202359390 | U | 8/2012 |
| CN | 202359396 | U | 8/2012 |
| CN | 302020695 | S | 8/2012 |
| CN | 202492706 | U | 10/2012 |
| CN | 202543634 | U | 11/2012 |
| CN | 202543635 | U | 11/2012 |
| CN | 202543646 | U | 11/2012 |
| CN | 202543652 | U | 11/2012 |
| CN | 102899848 | A | 1/2013 |
| CN | 202688698 | U | 1/2013 |
| CN | 202755220 | U | 2/2013 |
| CN | 202755221 | U | 2/2013 |
| CN | 102953249 | A | 3/2013 |
| CN | 102953250 | A | 3/2013 |
| CN | 102953262 | A | 3/2013 |
| CN | 102978870 | A | 3/2013 |
| CN | 103061084 | A | 4/2013 |
| CN | 103061085 | A | 4/2013 |
| CN | 103061086 | A | 4/2013 |
| CN | 103061087 | A | 4/2013 |
| CN | 103087839 | A | 5/2013 |
| CN | 103103720 | A | 5/2013 |
| CN | 103103721 | A | 5/2013 |
| CN | 103122566 | A | 5/2013 |
| CN | 103122567 | A | 5/2013 |
| CN | 202913242 | U | 5/2013 |
| CN | 103225192 | A | 7/2013 |
| CN | 203049283 | U | 7/2013 |
| CN | 103290653 | A | 9/2013 |
| CN | 103361934 | A | 10/2013 |
| CN | 103361938 | A | 10/2013 |
| CN | 203370359 | U | 1/2014 |
| CN | 103556439 | A | 2/2014 |
| CN | 203530695 | U | 4/2014 |
| CN | 203530700 | U | 4/2014 |
| CN | 203530714 | U | 4/2014 |
| CN | 203530718 | U | 4/2014 |
| CN | 203530723 | U | 4/2014 |
| CN | 203530725 | U | 4/2014 |
| CN | 103285643 | B | 4/2015 |
| CN | 103451894 | B | 11/2015 |
| CN | 103556434 | B | 11/2015 |
| CN | 103556436 | B | 11/2015 |
| CN | 103556431 | B | 1/2016 |
| CN | 103556432 | B | 3/2016 |
| CN | 105420992 | A | 3/2016 |
| CN | 105420993 | A | 3/2016 |
| CN | 105421000 | A | 3/2016 |
| CN | 105442267 | A | 3/2016 |
| CN | 205329373 | U | 6/2016 |
| CN | 205329374 | U | 6/2016 |
| CN | 205329380 | U | 6/2016 |
| CN | 205329384 | U | 6/2016 |
| EP | 0077463 | A2 | 4/1983 |
| EP | 2749685 | A1 | 7/2014 |
| EP | 2700744 | B1 | 3/2015 |
| JP | 2012-517876 | A | 8/2012 |
| JP | 2016-518886 | A | 6/2016 |
| WO | WO-2007/128962 | A1 | 11/2007 |
| WO | WO-2010/094959 | A1 | 8/2010 |
| WO | WO-2011/064581 | A1 | 6/2011 |
| WO | WO-2011/098815 | A1 | 8/2011 |
| WO | WO-2012/035343 | A1 | 3/2012 |
| WO | WO-2012/056252 | A2 | 5/2012 |
| WO | WO-2012/167545 | A1 | 12/2012 |

(56) References Cited

FOREIGN PATENT DOCUMENTS

| | | | |
|---|---|---|---|
| WO | WO-2014/006424 | A1 | 1/2014 |
| WO | WO-2014/006425 | A1 | 1/2014 |
| WO | WO-2014/147389 | A1 | 9/2014 |
| WO | WO-2014/147390 | A1 | 9/2014 |
| WO | WO-2014/147391 | A1 | 9/2014 |
| WO | WO-2014/167358 | A2 | 10/2014 |
| WO | WO-2014/167359 | A2 | 10/2014 |
| WO | WO-2015/004444 | A1 | 1/2015 |
| WO | WO-2016/005118 | A1 | 1/2016 |
| WO | WO-2016/055788 | A1 | 4/2016 |
| WO | WO-2016/055789 | A1 | 4/2016 |
| WO | WO-2017/178831 | A2 | 10/2017 |
| WO | WO-2018/172725 | A1 | 9/2018 |
| WO | WO-2019/073270 | A1 | 4/2019 |
| WO | WO-2020/012024 | A1 | 1/2020 |
| WO | WO-2020/012027 | A1 | 1/2020 |
| WO | WO-2020/064830 | A1 | 4/2020 |
| WO | WO-2021/014152 | A1 | 1/2021 |
| WO | WO-2021/032986 | A1 | 2/2021 |

OTHER PUBLICATIONS

U.S. Appl. No. 17/271,497, Xeros Ltd.
U.S. Appl. No. 17/280,519, Xeros Ltd.
International Search Report and Written Opinion for International Patent Application No. PCT/EP2019/068911, dated Oct. 10, 2019 (13 pages).
UKIPO Search Report for GB Application No. GB1811569.1, dated Jan. 7, 2019 (1 page).
U.S. Appl. No. 18/023,229, Servin et al.
U.S. Appl. No. 18/032,453, Xeros Ltd.
U.S. Appl. No. 18/035,442, Mattley et al.
U.S. Appl. No. 18/265,178, Mattley et al.

* cited by examiner

APPARATUS AND METHOD FOR TREATING A SUBSTRATE WITH SOLID PARTICLES

The present disclosure relates to an apparatus that employs a multiplicity of solid particles in the treatment of substrates, particularly a substrate which is or comprises a textile. The present disclosure further relates to a method for the treatment of substrates with solid particles using the apparatus. The present disclosure further relates to components of the apparatus, in particular to the lifter of the apparatus. The present disclosure particularly relates to an apparatus, components thereof (in particular to the lifters) and a method suitable for cleaning of soiled substrates. The present disclosure further relates to a kit and method suitable for retrofitting or converting an apparatus into an apparatus according to the present disclosure.

Conventional methods for treating and cleaning of textiles and fabrics typically involve aqueous cleaning using large volumes of water. These methods generally involve aqueous submersion of fabrics followed by soil removal, aqueous soil suspension, and water rinsing. The use of solid particles to provide improvements in, and advantages over, these conventional methods is known in the art. For example PCT patent publication WO2007/128962 discloses a method for cleaning a soiled substrate using a multiplicity of solid particles. Other PCT patent publications which have related disclosures of cleaning methods include: WO2012/056252; WO2014/006424; WO2015/004444; WO2014/147390; WO2014/147391; WO2014/06425; WO2012/035343 WO2012/167545; WO2011/098815; WO2011/064581; WO2010/094959; and WO2014/147389. These disclosures teach apparatus and methods for treating or cleaning a substrate which offers several advantages over conventional methods including: improved treating/cleaning performance, reduced water consumption, reduced consumption of detergent and other treatment agents, and better low temperature treating/cleaning (and thus more energy efficient treating/cleaning). Other patent applications, for instance WO2014/167358, WO2014/167359, WO2016/05118, WO/2016/055789 and WO2016/055788, teach the advantages provided by solid particles in other fields such as leather treatment and tanning.

It would be desirable to provide even better apparatus for treatment methods which involve the use of a multiplicity of solid particles. In particular, it would be desirable to improve the efficiency and reliability, to further reduce water consumption, to facilitate quieter operation, to improve fabric care, and/or to reduce the power consumption and costs (including capital costs and/or running costs) of the apparatus and the operation thereof. It would also be desirable to reduce the complexity of the apparatus and the number of moving components therein. Furthermore, it would also be desirable to retrofit a conventional apparatus so that it is suitable for operation with a multiplicity of solid particles.

The present Applicant's pending PCT application PCT/GB2017/053815 discloses an apparatus in which solid particles are stored in a rotatable drum which further provides a plurality of dispensing flow path(s) for the solid particles to flow from the storage compartment(s) to the interior of the drum, and a plurality of collecting flow paths for the solid particles to flow from the interior of the drum to the storage compartment(s), such that the direction of flow between the storage compartment(s) and the interior of the drum is controlled by the direction of rotation of the drum.

The present inventors sought to provide further improvements to the apparatus. In particular, the present inventors sought to increase the rate of collection of solid particles from the interior of the drum. Furthermore, the present inventors sought to reduce the complexity of cycles of rotations needed in order to collect solid particles from the interior of the drum while also keeping substrate tangling to a minimum.

It is an object of the present invention to address one or more of the aforementioned problems.

According to a first aspect of the invention, there is provided an apparatus for use in the treatment of substrates with a solid particulate material, said apparatus comprising a housing having mounted therein a rotatably mounted drum having an inner surface and an end wall and access means for introducing said substrates into said drum, wherein (a) said drum comprises storage means for storage of said solid particulate material; and (b) said drum comprises a first collecting flow path to facilitate flow of said solid particulate material from the interior of said drum to said storage means when said drum rotates in a first collecting direction, characterised in that said drum comprises a second collecting flow path to facilitate flow of said solid particulate material from the interior of said drum to said storage means when said drum rotates in a second collecting direction, wherein said second collecting direction is in the opposite rotational direction to said first collecting direction, and wherein said first collecting flow path and said second collecting flow path are different flow paths.

It will be appreciated that the term "in the opposite rotational direction" means that if the drum is rotating in a first collecting direction that is clockwise, then the second collecting direction is counter-clockwise. Similarly, if the second collecting direction is clockwise, then the first collecting direction is counter-clockwise.

The apparatus of the present invention can collect solid particulate material from the interior of the drum regardless of the direction in which the drum is rotated. As such, the apparatus of the present invention can enable a reduced number and/or less complex series of substrate treatment rotation cycles. In particular, when drum rotation direction is reversed in order to reduce or avoid tangling of substrates during treatment, collection of solid particulate material from the interior of the drum is still able to continue. In this way, the apparatus of the present invention is able to continually collect the solid particulate material from the interior of the drum.

The apparatus of the present invention can also dispense with, and preferably does not comprise, a further storage means which is not attached to or integral with the drum (for instance a sump for storage of solid particulate material, such as a sump located beneath the drum). Similarly, the apparatus can dispense with, and preferably does not comprise, a pump for circulating said solid particulate material between the storage means and the interior of the drum (i.e. from the storage means to the interior of the drum, and from the interior of the drum to the storage means). Preferably, the apparatus can dispense with, and preferably does not comprise, a pump for circulating said solid particulate material.

In addition, the amount of water used in the treatment of the substrates is reduced because water is not required to transport the solid particulate material around the apparatus. The apparatus and methods of the present invention therefore only require the water needed as the liquid medium in the treatment of the substrates, which provides a significant reduction in water consumption.

A further advantage of the storage means being located in the rotatable drum is that solid particulate material can be centrifugally dried, i.e. it can undergo one or more spin cycles to dry the particles. Centrifugal drying of the solid particulate material may be separate from or included in the operation of the apparatus to treat substrates. For instance, centrifugal drying may be effected concurrently with extraction step(s) for removing liquid medium, as described herein. Thus, the method described herein for treating a substrate optionally comprises the step of centrifugal drying of the solid particulate material. It will therefore be appreciated that an advantage of the present invention is the dry storage of the solid particulate material.

Preferably, the drum is configured to bias solid particulate material present inside the drum towards said first collecting apertures during rotation of the drum in said first collecting direction and/or towards said second collecting apertures during rotation of the drum in said second collecting direction.

It will be appreciated that the rate of flow of the solid particulate material between the interior of the drum and the storage means may also be controlled, additionally or alternatively, by varying the rate of rotation of the drum and/or by intermittently rotating the drum.

The apparatus is preferably a front-loading apparatus, with the access means disposed in the front of the apparatus. Preferably the access means is or comprises a door. It will be appreciated that the drum has an opening at the opposite end of the drum to the end wall, suitably wherein the opening is aligned with the access means, and through which opening said substrates are introduced into said drum.

The rotatably mounted drum (also referred to herein as a rotatable drum) is preferably cylindrical, but other configurations are also envisaged, including for instance hexagonal drums.

Thus, the inner surface of the drum is preferably a cylindrical inner surface.

The inner surface of the drum is the surface of the inner wall(s) of the drum. The inner wall(s) of the drum is/are joined to the end wall of the drum at the juncture of the inner and end walls. Thus, the inner surface is the surface of the inner wall of the drum which is disposed around the rotational axis of the drum, i.e. substantially perpendicular to the end wall of the drum.

For a cylindrical drum, the axis of the cylindrical drum is preferably the rotational axis of the drum. More generally, the inner and end walls of the drum define a three-dimensional volume in which the end wall intersects the rotational axis of the drum, and preferably intersects said rotational axis in a substantially perpendicular manner, and wherein the inner wall(s) is/are disposed around the rotational axis, preferably wherein the inner walls are substantially parallel to the rotational axis.

The inner surface of the drum preferably comprises perforations which have dimensions smaller than the longest dimension of the solid particulate material so as to permit passage of fluids into and out of said drum but to prevent egress of said solid particulate material (which is the opposite of many prior art apparatus, in which both fluids and solid particulate material exit the drum via perforations in its inner surface). Preferably the housing of the apparatus is a tub which surrounds said drum, preferably wherein said tub and said drum are substantially concentric, preferably wherein the walls of said tub are unperforated but having disposed therein one or more inlets and/or one or more outlets suitable for passage of a liquid medium and/or one or more treatment formulation(s) into and out of the tub. Thus, the tub is suitably water-tight, permitting ingress and egress of the liquid medium and other liquid components only through pipes or ducting components.

Preferably, the drum is disposed in the apparatus such that the axis of the drum is substantially horizontal. In a preferred embodiment, the drum is disposed in the apparatus such that the axis of the drum is substantially horizontal during at least part of the operation of the apparatus, and preferably during the whole of the operation of the apparatus. The improved collection rate of the apparatus of the present invention provides significant improvement in the collection efficiency for apparatus in which the axis of the drum is substantially horizontal during operation.

In an alternative embodiment, the apparatus and/or drum (and particularly the drum) is tiltable, as is known in the art, such that the axis of the drum to the horizontal plane can be varied before, during or after the treatment of the substrates in the apparatus, and preferably during the treatment or portion thereof, and particularly during rotation of the drum in a collecting direction. Tilting may be effected by any suitable means, including for instance an air bag, hydraulic ram, pneumatic piston and/or electric motor. In this embodiment, the drum and/or apparatus is tiltable preferably such that the axis of the drum defines an angle $\alpha$ to the horizontal plane which is greater than 0 and less than about 10°. In this embodiment, the drum and/or apparatus is preferably configured to be tiltable such that the drum is inclined in a downwards direction from the front of the drum to the end wall of the drum during at least a part of said treatment, and particularly during rotation of the drum in a collecting direction. Thus, the apparatus is suitably configured such that for at least a part of said treatment (particularly during rotation of the drum in a collecting direction) the axis of the drum is tilted such that it defines an angle $\alpha$ to the horizontal plane which is greater than 0 and less than about 10° and such that the drum is inclined in a downwards direction from the front of the drum to the end wall of the drum.

Advantageously, during operation of the apparatus of the present invention, neither the drum nor the tub allows ingress or egress of the solid particulate material, which is retained by the drum throughout the treatment cycle by which substrates are treated in the apparatus. In other words, the solid particulate material remains in the storage means and/or in the interior of the drum and/or in the flow paths between the storage means and the interior of the drum throughout the treatment cycle, thereby obviating the need for a pump to circulate the particulate material and thereby obviating the need for a further storage means (such as a sump) which is not attached to or integral with the drum.

The apparatus preferably comprises a seal between the access means and the tub such that, in use, liquid medium is not able to exit the tub. Preferably, said seal is a door seal, as is conventional in the art. The seal between the access means and the tub prevents water leakage from the apparatus. The apparatus preferably further comprises a seal which prevents egress of the solid particulate material from the drum at the periphery thereof, in order to prevent egress of solid particulate material into the tub or egress of solid particulate material from the apparatus at the periphery of the access means, and such a seal is preferably disposed as a seal between the access means and the drum. Typically, said seal is made from foam or rubber or some other resiliently flexible material.

The apparatus further comprises the typical components present in apparatus suitable for the treatment of substrates with solid particulate material, preferably in a liquid medium and/or in combination with one or more treatment formulation(s) as described in more detail hereinbelow.

Thus, the apparatus preferably comprises at least one pump for circulation of the liquid medium, and associated ports and/or piping and/or ducting for transport of the liquid medium and/or one or more treatment formulation(s) into the apparatus, into the drum, out of the drum, and out of the apparatus. Preferably, the apparatus comprises a suitable drive means to effect rotation of the drum, and suitably a drive shaft to effect rotation of the drum. Preferably, the apparatus comprises heating means for heating the liquid medium. Preferably, the apparatus comprises mixing means to mix the liquid medium with one or more treatment formulation(s). The apparatus may further comprise one or more spray means to apply a liquid medium and/or one or more treatment formulation(s) into the interior of the drum and onto the substrate during the treatment thereof.

The apparatus typically further comprises an external casing, which surrounds the tub and drum.

It will be appreciated that the apparatus suitably further comprises a control means programmed with instructions for the operation of the apparatus according to at least one treatment cycle. The apparatus suitably further comprises a user interface for interfacing with the control means and/or apparatus.

The apparatus preferably comprises said solid particulate material.

Typically, said drum has a first elongate protrusion located on said inner surface of said drum wherein said first elongate protrusion extends in a direction away from said end wall, wherein said first elongate protrusion has an end proximal to the end wall and an end distal to the end wall, wherein said first elongate protrusion comprises said first collecting flow path and further comprises a first collecting aperture, and wherein said first collecting aperture defines the start of said first collecting flow path.

Said first elongate protrusion located on the inner surface of the drum in the apparatus of the present invention is a type of "lifter". Lifters are used in conventional apparatus, as well as in apparatus adapted for the treatment of substrates using solid particulate material, to encourage circulation and agitation of the contents (i.e. the substrate(s), treatment agents and solid particulate material) within the drum during rotation of the drum.

Typically, said first elongate protrusion is disposed on the inner surface of the drum such that the elongate dimension of the protrusion is essentially perpendicular to the direction of rotation of the drum.

Preferably, said first collecting aperture is disposed in a first side of said first elongate protrusion, wherein said first side of said first elongate protrusion is the leading side of said first elongate protrusion during rotation of the drum in said first collecting direction.

Said first elongate protrusion may comprise a plurality of said first collecting apertures disposed in said first side of said first elongate protrusion at a plurality of positions from the proximal end to the distal end thereof. Typically, there may be from about 2 to about 200, from about 3 to about 100, from about 4 to about 50, from about 5 to about 30, from about 6 to about 25, or from about 10 to about 20 first collecting apertures disposed on said first side of said first elongate protrusion. For domestic washing machines, preferably there are from about 5 to about 15 first collecting apertures disposed on said first side of said first elongate protrusion. For commercial substrate treatment machines, preferably there are from about 5 to about 100 first collecting apertures disposed on said first side of said first elongate protrusion.

Said first collecting aperture(s) may be any suitable size and shape to allow ingress of solid particulate material into said first collecting flow path. Typically, the shape of said first collecting aperture(s) is substantially rectangular, substantially circular, substantially square or substantially oval in shape. Preferably, the shape of said first collecting aperture(s) is substantially rectangular. Preferably, the first collecting aperture(s) is positioned in order that entry of said solid particulate material from the interior of said drum to the first collecting flow path is as free-flowing as possible. Preferably, the first collecting aperture(s) is adjacent the inner surface of said drum. Typically, said first elongate protrusion comprises an arrangement of a plurality of first collecting apertures such that substantially the entire length of the first side of said first elongate protrusion from the proximal end to the distal end comprises first collecting apertures. Preferably, each aperture is separated from its neighbour or neighbours by a distance of about 10 mm or less, about 8 mm or less, about 5 mm or less, about 3 mm or less or about 1 mm or less. Preferably, the first collecting apertures comprise from about 50 to about 95%, preferably from about 60 to about 90% of the length of the first side of said first elongate protrusion. Having an arrangement with a plurality of closely spaced first collecting apertures allows for efficient collection (also known as "harvesting") of solid particulate material from the interior of said drum. In particular, such an arrangement advantageously increases the opportunities for solid particulate material in the interior of the drum to strike a first collecting aperture when the drum is rotated in said first collecting direction and thus allows for ingress of said solid particulate material into said first collecting flow path.

Preferably the first side of said first elongate protrusion is adapted to bias solid particulate material towards said first collecting aperture(s).

For instance, said first collecting aperture(s) may have a funnel shape to increase the cross-sectional area at the entry to said first collecting flow path and thereby increase the probability of entry of solid particulate material into said first collecting flow path.

Additionally or alternatively, the region between adjacent first collecting apertures may be angled towards a collecting aperture, thereby encouraging solid particulate material to enter the collecting flow path.

Optionally, said first elongate protrusion may comprise a collecting groove along at least part of said first side, wherein the collecting groove is configured to collect solid particulate material during rotation in said first collecting direction, whereupon the solid particulate material is biased towards said first collecting aperture(s) during further rotation in said first collecting direction. Such a collecting groove is preferably disposed in said first elongate protrusion along at least part of the edge of said first elongate protrusion where it meets the inner wall of the drum.

Preferably, said first elongate protrusion is configured to bias solid particulate material in said first collecting flow path towards the storage means during rotation of the drum in said first collecting direction. Preferably, said first elongate protrusion is further configured to prevent, more preferably to eliminate, solid particulate material present in said first collecting flow path from returning to the interior of said drum when the drum rotates in said second collecting direction. For instance, said first elongate protrusion may comprise one or more flap, paddle, gate or combination thereof that adopts an open position that permits solid particulate material in the first collecting flow path moving towards the storage means when the drum is rotating in said first collecting direction but adopts a closed position that prevents solid particulate material from re-entering the interior of said drum when the drum is rotating in said second collecting direction.

More preferably, said first elongate protrusion is configured to bias solid particulate material in said first collecting flow path towards the storage means during rotation of the drum in both said first collecting direction and in said second collecting direction. In this way, solid particulate material that has entered said first collecting flow path is able to continue to move towards the storage means even when the direction of rotation of the drum is reversed. This arrangement significantly reduces, and preferably completely eliminates, the amount of solid particulate material that re-enters the interior of the drum from said first collecting flow path when the direction of rotation of the drum is reversed. For instance, said first elongate protrusion may comprise an arrangement of deflectors that urges solid particulate material towards the storage means regardless of the direction of rotation of said drum.

Said first elongate protrusion may comprise one or more curved surfaces, or "ramps", adjacent to said first collecting apertures that urges solid particulate material somewhat radially inwards and more towards the central axis of rotation of the drum. Having a curved surface adjacent to a first collecting aperture can provide improved capture of the solid particulate material when the drum rotates at varying speeds. In addition, this arrangement helps prevent solid particulate material from exiting the first collecting apertures and re-entering the interior of said drum. Having a curved surface adjacent said first collecting apertures is particularly preferable where said first elongate protrusion comprises an arrangement of deflectors.

BIDIRECTIONAL ELONGATE PROTRUSIONS

In a first preferred embodiment, said first elongate protrusion further comprises said second collecting flow path and a second collecting aperture, wherein said second collecting aperture defines the start of said second collecting flow path. In this arrangement, said first elongate protrusion comprises both said first collecting flow path and said second collecting flow path. In this way, said first elongate protrusion is able to collect solid particulate material regardless of the direction of rotation of the drum. As such, this arrangement of the first elongate protrusion may also be known as a "bidirectional elongate protrusion" or a "bidirectional lifter".

Said second collecting aperture may be disposed in a second side of said first elongate protrusion, wherein said second side of said first elongate protrusion is the leading side of said first elongate protrusion during rotation of the drum in said second collecting direction.

Said first elongate protrusion may comprise a plurality of said second collecting apertures disposed in said second side of said first elongate protrusion at a plurality of positions from the proximal end to the distal end thereof. Typically, there may be from about 2 to about 200, from about 3 to about 100, from about 4 to about 50, from about 5 to about 30, from about 6 to about 25, or from about 10 to about 20 second collecting apertures disposed on said second side of said first elongate protrusion. For domestic washing machines, preferably there are from about 5 to about 15 second collecting apertures disposed on said second side of said first elongate protrusion. For commercial substrate treatment machines, preferably there are from about 5 to about 100 second collecting apertures disposed on said second side of said first elongate protrusion.

Said second collecting aperture(s) may be any suitable size and shape to allow ingress of solid particulate material into said second collecting flow path. Typically, the shape of said second collecting aperture(s) is substantially rectangular, substantially circular, substantially square or substantially oval in shape. Preferably, the shape of said second collecting aperture(s) is substantially rectangular. Preferably, the second collecting aperture(s) is positioned in order that entry of said solid particulate material from the interior of said drum to the second collecting flow path is as free-flowing as possible. Preferably, the second collecting aperture(s) is adjacent the inner surface of said drum. Typically, said first elongate protrusion comprises an arrangement of a plurality of second collecting apertures such that substantially the entire length of the second side of said first elongate protrusion from the proximal end to the distal end comprises second collecting apertures. Preferably, each aperture is separated from its neighbour or neighbours by a distance of about 10 mm or less, about 8 mm or less, about 5 mm or less, about 3 mm or less or about 1 mm or less. Preferably, the second collecting apertures comprise from about 50 to about 95%, preferably from about 60 to about 90% of the length of the second side of said first elongate protrusion. Having an arrangement with a plurality of closely spaced second collecting apertures allows for efficient collection (also known as "harvesting") of solid particulate material from the interior of said drum. In particular, such an arrangement advantageously increases the opportunities for solid particulate material in the interior of the drum to strike a second collecting aperture when the drum is rotated in said second colleting direction and thus allows for ingress of said solid particulate material into said second collecting flow path.

Preferably the second side of said first elongate protrusion is adapted to bias solid particulate material towards said second collecting aperture(s).

For instance, said second collecting aperture(s) may have a funnel shape to increase the cross-sectional area at the entry to said second collecting flow path and thereby increase the probability of entry of solid particulate material into said second collecting flow path.

Additionally or alternatively, the region between adjacent second collecting apertures may be angled towards a collecting aperture, thereby encouraging solid particulate material to enter said second collecting flow path.

Optionally, said first elongate protrusion may comprise a collecting groove along at least part of the second side, wherein the collecting groove is configured to collect solid particulate material during rotation in said second collecting direction, whereupon the solid particulate material is biased towards the second collecting aperture(s) during further rotation in said second collecting direction. Such a collecting groove is preferably disposed in said first elongate protrusion along at least part of the edge of said first elongate protrusion where it meets the inner wall of the drum.

Preferably, said first elongate protrusion is configured to bias solid particulate material in said second collecting flow path towards the storage means during rotation of the drum in said second collecting direction. Preferably, said first elongate protrusion is further configured to prevent, more preferably to eliminate, solid particulate material present in said second collecting flow path from returning to the interior of said drum when the drum rotates in said first collecting direction. For instance, said first elongate protrusion may comprise one or more flap, paddle, gate or combination thereof that adopts an open position that permits solid particulate material in said second collecting flow path moving towards the storage means when the drum is rotating in said second collecting direction but adopts a closed position that prevents solid particulate material from re-entering the interior of said drum when the drum is rotating in said first collecting direction.

More preferably, said first elongate protrusion is configured to bias solid particulate material in said second collecting flow path towards the storage means during rotation of the drum in both said first collecting direction and in said second collecting direction. In this way, solid particulate material that has entered said second collecting flow path is able to continue to move towards the storage means even when the direction of rotation of the drum is reversed. This arrangement significantly reduces, and preferably completely eliminates, the amount of solid particulate material that re-enters the interior of the drum from said second collecting flow path when the direction of rotation of the drum is reversed. For instance, said first elongate protrusion may comprise an arrangement of deflectors that urges solid particulate material towards the storage means regardless of the direction of rotation of said drum.

Said first elongate protrusion may comprise one or more curved surfaces, or "ramps", adjacent to said second collecting apertures that urges solid particulate material somewhat radially inwards and more towards the central axis of rotation of the drum. Having a curved surface adjacent to a second collecting aperture can provide improved capture of the solid particulate material when the drum rotates at varying speeds. In addition, this arrangement helps prevent solid particulate material from exiting the second collecting apertures and re-entering the interior of said drum. Having a curved surface adjacent said second collecting apertures is particularly preferable where said first elongate protrusion comprises an arrangement of deflectors.

Typically, said first elongate protrusion is rectilinear in shape.

Preferably, said first collecting flow path and said second collecting flow path are symmetrically arranged along the length of said first elongate protrusion.

Preferably, said first elongate protrusion comprises a first lengthwise portion and a second lengthwise portion. Preferably, said first lengthwise portion and said second lengthwise portion are symmetrically arranged along the length of said first elongate protrusion.

Solid particulate material that is in the first collecting flow path is preferably urged along said first lengthwise portion towards said storage means as said drum rotates in said first collecting direction. Preferably, when said drum rotates in said second collecting direction, said solid particulate material in said first collecting flow path may transfer to said second lengthwise portion and be urged towards said storage means as said drum rotates in said second collecting direction. Similarly, solid particulate material that is in the second collecting flow path is preferably urged along said second lengthwise portion towards said storage means as said drum rotates in said second collecting direction. Preferably, when said drum rotates in said first collecting direction, said solid particulate material in said second collecting flow path may transfer to said first lengthwise portion and be urged towards said storage means as said drum rotates in said first collecting direction.

Preferably, said first elongate protrusion comprises a barrier projecting from a base portion of said first elongate protrusion adjacent the inner surface of said drum, wherein said barrier extends at least partially towards a top portion of said first elongate protrusion, wherein said barrier at least partially separates said first lengthwise portion from said second lengthwise portion. Solid particulate material that enters said first elongate protrusion by a first collecting aperture is urged to follow said first collecting flow path as the drum rotates, whereas solid particulate material that enters said first elongate protrusion by a second collecting aperture is urged to follow said second collecting flow path as the drum rotates.

The barrier may comprise a first barrier wall and a second barrier wall both projecting from a base portion of said first elongate protrusion adjacent the inner surface of said drum. Both the first barrier wall and the second barrier wall are spaced apart to define a central space therebetween. The first and second barrier walls may be arranged parallel to each other and may optionally be spaced apart by a third barrier wall. The central space may therefore be bounded by the first, second, third barrier wall and the base portion. Alternatively, the first and second barrier walls may be angled relative to each other such that they join with an apex positioned towards the centre of the drum. The central space may therefore be bounded by the first and second barrier walls and the base portion. The first and second collecting flow paths may be located on the external sides of the first and second barrier walls, i.e. the opposite sides of the barrier walls to the central space. Preferably, said barrier at least partially separates said first lengthwise portion from said second lengthwise portion. In arrangements where the first collecting flow path and/or the second collecting flow path comprises a series of deflectors, the deflectors in said first lengthwise portion may be connected to the first barrier wall and deflectors in said second lengthwise portion may be connected to the second barrier wall. Connecting the deflectors of said first and second lengthwise portion to separate first and second barrier walls may improve the ease of manufacture of the elongate protrusion.

Preferably, said first elongate protrusion is configured such that solid particulate material that is in the first collecting flow path is able to move over the top of said barrier into said second lengthwise portion when the drum changes rotation direction from said first collecting direction to said second collecting direction. Preferably, said first elongate protrusion is configured such that solid particulate material that is in the second collecting flow path is able to move over the top of said barrier into said first lengthwise portion when the drum changes rotation direction from said second collecting direction to said first collecting direction.

Preferably, said first side and/or said second side of said first elongate protrusion is inclined so that the width of said first elongate protrusion is narrower at a top portion of said first elongate protrusion than at a base portion of the elongate protrusion adjacent the inner surface of said drum.

The apparatus of the present invention preferably comprises a plurality of said first elongate protrusions. The drum preferably has from 2 to 10, preferably 2, 3, 4, 5 or 6 and preferably 2, 3 or 4, and preferably 3 or 4, of said first elongate protrusions. For domestic washing machines, 3 protrusions are most preferred. For commercial washing machines, 4, 5 or 6 protrusions, and preferably 6 protrusions, are most preferred. Where a plurality of first elongate protrusions are located on the inner surface of the drum, all of the elongate protrusions typically have the same or substantially the same dimensions as each other. In alternative embodiments, a plurality of first elongate protrusions may have elongate protrusions of differing dimensions, i.e.

one or more elongate protrusions of a first size and/or shape, and one or more elongate protrusions of a second size and/or shape, etc.

As noted above, the first elongate protrusion is a type of "lifter". As such, according to a second aspect of the invention, there is provided a lifter for use in a rotatably mounted drum of an apparatus for use in the treatment of substrates with a solid particulate material, the lifter comprising:

(a) an elongate body having a proximal end and a distal end;

(b) a base portion having means for connecting to an inner surface of said drum;

(c) a first side extending from said base portion towards a top portion of said lifter, wherein said first side forms a leading edge when said drum rotates in a first collecting direction;

(d) a second side extending from said base portion towards said top portion of said lifter, wherein said second side forms a leading edge when said drum rotates in a second collecting direction, wherein said second collecting direction is in the opposite rotational direction to said first collecting direction;

(e) a first collecting flow path to facilitate flow of said solid particulate material from the interior of said drum to a storage means in said drum when said drum rotates in said first collecting direction; and (f) a first collecting aperture disposed in said first side, wherein said first collecting aperture defines the start of said first collecting flow path, characterised in that said lifter comprises a second collecting flow path to facilitate flow of said solid particulate material from the interior of said drum to said storage means when said drum rotates in said second collecting direction, wherein said lifter comprises a second collecting aperture disposed in said second side, wherein said second collecting aperture defines the start of said second collecting flow path, and wherein said first collecting flow path and said second collecting flow path are different flow paths.

In this arrangement, said lifter comprises both said first collecting flow path and said second collecting flow path. In this way, said lifter can collect solid particulate material regardless of the direction of rotation of the drum. As such, said lifter may also be known as a "bidirectional lifter". It will be appreciated that the features, preferences and embodiments described herein in respect of the first preferred embodiment of said first elongate protrusion are applicable also to the lifter of the second aspect of the invention.

According to a third aspect of the invention, there is provided an apparatus for use in the treatment of substrates with a solid particulate material, said apparatus comprising a housing having mounted therein a rotatably mounted drum having an inner surface and an end wall and access means for introducing said substrates into said drum, wherein said drum comprises:

(a) storage means for storage of said solid particulate material; and (b) at least one lifter according to the invention described herein.

It will be appreciated that the features, preferences and embodiments described herein in respect of the apparatus and solid particulate material are applicable to the third aspect of the invention.

Apparatus Having Said Second Collecting Flow Path in a Separate Elongate Protrusion In a second preferred embodiment, said drum further comprises a second elongate protrusion located on said inner surface of said drum, wherein said second elongate protrusion extends in a direction away from said end wall, wherein said second elongate protrusion has an end proximal to the end wall and an end distal to the end wall, wherein said second elongate protrusion comprises said second collecting flow path and a second collecting aperture, wherein said second collecting aperture defines the start of said second collecting flow path. In this way, in addition to a first elongate protrusion as described above, the drum comprises a second elongate protrusion that is able to collect solid particulate material when the drum rotates in a second collecting direction.

The apparatus of the present invention may comprise a drum comprising said second elongate protrusion and a first elongate protrusion, wherein said first elongate protrusion comprises only a first collecting flow path. Alternatively, the apparatus of the present invention may comprise a drum comprising said second elongate protrusion and a first elongate protrusion, wherein said first elongate protrusion comprises a first collecting flow path and a second collecting flow path. Preferably, when said drum comprises a second elongate protrusion, said first elongate protrusion comprises a first collecting flow path and does not comprise a second collecting flow path.

Said second elongate protrusion located on the inner surface of the drum in the apparatus of the present invention is a type of "lifter". Typically, said second elongate protrusion is disposed on the inner surface of the drum such that the elongate dimension of the protrusion is essentially perpendicular to the direction of rotation of the drum.

Said second collecting aperture may be disposed in a first side of said second elongate protrusion, wherein said first side of said second elongate protrusion is the leading side of said second elongate protrusion during rotation of the drum in said second collecting direction.

Said second elongate protrusion may comprise a plurality of said second collecting apertures disposed in said first side of said second elongate protrusion at a plurality of positions from the proximal end to the distal end thereof. Typically, there may be from about 2 to about 200, from about 3 to about 100, from about 4 to about 50, from about 5 to about 30, from about 6 to about 25, or from about 10 to about 20 second collecting apertures disposed on said first side of said second elongate protrusion. For domestic washing machines, preferably there are from about 5 to about 15 second collecting apertures disposed on said first side of said second elongate protrusion. For commercial substrate treatment machines, preferably there are from about 5 to about 100 second collecting apertures disposed on said first side of said second elongate protrusion.

Said second collecting aperture(s) may be any suitable size and shape to allow ingress of solid particulate material into said second collecting flow path. Typically, the shape of said second collecting aperture(s) is substantially rectangular, substantially circular, substantially square or substantially oval in shape. Preferably, the shape of said second collecting aperture(s) is substantially rectangular. Preferably, the second collecting aperture(s) is positioned in order that entry of said solid particulate material from the interior of said drum to the second collecting flow path is as free-flowing as possible.

Preferably, the second collecting aperture(s) is adjacent the inner surface of said drum. Typically, said second elongate protrusion comprises an arrangement of a plurality of second collecting apertures such that substantially the entire length of the first side of said second elongate protrusion from the proximal end to the distal end comprises second collecting apertures. Preferably, each aperture is separated from its neighbour or neighbours by a distance of about 10 mm or less, about 8 mm or less, about 5 mm or less, about 3 mm or less or about 1 mm or less. Preferably, the second collecting apertures comprise from about 50 to about 95%, preferably from about 60 to about 90% of the length of the first side of said second elongate protrusion. Having an arrangement with a plurality of closely spaced second collecting apertures allows for efficient collection (also known as "harvesting") of solid particulate material from the interior of said drum. In particular, such an arrangement advantageously increases the opportunities for solid particulate material in the interior of the drum to strike a second collecting aperture when the drum is rotated in said second colleting direction and thus allows for ingress of said solid particulate material into said second collecting flow path.

Preferably the first side of said second elongate protrusion is adapted to bias solid particulate material towards said second collecting aperture(s).

For instance, said second collecting aperture(s) may have a funnel shape to increase the cross-sectional area at the entry to said second collecting flow path and thereby increase the probability of entry of solid particulate material into said second collecting flow path.

Additionally or alternatively, the region between adjacent second collecting apertures may be angled towards a collecting aperture, thereby encouraging solid particulate material to enter said second collecting flow path.

Optionally, said second elongate protrusion may comprise a collecting groove along at least part of the first side, wherein the collecting groove is configured to collect solid particulate material during rotation in said second collecting direction, whereupon the solid particulate material is biased towards the second collecting aperture(s) during further rotation in said second collecting direction. Such a collecting groove is preferably disposed in said second elongate protrusion along at least part of the edge of said second elongate protrusion where it meets the inner wall of the drum.

Preferably, said second elongate protrusion is configured to bias solid particulate material in said second collecting flow path towards the storage means during rotation of the drum in said second collecting direction. Preferably, said second elongate protrusion is further configured to prevent, more preferably to eliminate, solid particulate material present in said second collecting flow path from returning to the interior of said drum when the drum rotates in said first collecting direction. For instance, said second elongate protrusion may comprise one or more flap, paddle, gate or combination thereof that adopts an open position that permits solid particulate material in the second collecting flow path moving towards the storage means when the drum is rotating in said second collecting direction but adopts a closed position that prevents solid particulate material from re-entering the interior of said drum when the drum is rotating in said first collecting direction.

More preferably, said second elongate protrusion is configured to bias solid particulate material in said second collecting flow path towards the storage means during rotation of the drum in both said first collecting direction and in said second collecting direction. In this way, solid particulate material that has entered said second collecting flow path is able to continue to move towards the storage means even when the direction of rotation of the drum is reversed. This arrangement significantly reduces, and preferably completely eliminates, the amount of solid particulate material that re-enters the interior of the drum from said second collecting flow path when the direction of rotation of the drum is reversed. For instance, said second elongate protrusion may comprise an arrangement of deflectors that urges solid particulate material towards the storage means regardless of the direction of rotation of said drum.

Said second elongate protrusion may comprise one or more curved surfaces, or "ramps", adjacent to said second collecting apertures that urges solid particulate material somewhat radially inwards and more towards the central axis of rotation of the drum. Having a curved surface adjacent to a second collecting aperture can provide improved capture of the solid particulate material when the drum rotates at varying speeds. In addition, this arrangement helps prevent solid particulate material from exiting the second collecting apertures. Having a curved surface adjacent said second collecting apertures is particularly preferable where said second elongate protrusion comprises an arrangement of deflectors.

Preferably, said second elongate protrusion is spaced apart from said first elongate protrusion on said inner surface of said drum.

Preferably, said second elongate protrusion is rectilinear. Preferably, said first elongate protrusion and said second elongate protrusion are rectilinear.

The apparatus of the present invention preferably comprises a plurality of said first elongate protrusions and said second elongate protrusions. The drum preferably has from 2 to 10, preferably 2, 3, 4, 5 or 6 and preferably 2, 3 or 4, and preferably 3 or 4, of said first and second elongate protrusions. For domestic washing machines, 3 protrusions are most preferred. For commercial washing machines, 5 or 6 protrusions, and preferably 6 protrusions, are most preferred. Preferably, the drum comprises equal numbers of said first and said second elongate protrusions. Where a plurality of first and second elongate protrusions are located on the inner surface of the drum, all of the elongate protrusions typically have the same or substantially the same dimensions as each other. In alternative embodiments, a plurality of first and second elongate protrusions may have differing dimensions, i.e. one or more first and/or second elongate protrusions of a first size and/or shape, and one or more first and/or second elongate protrusions of a second size and/or shape, etc.

Figure 2:
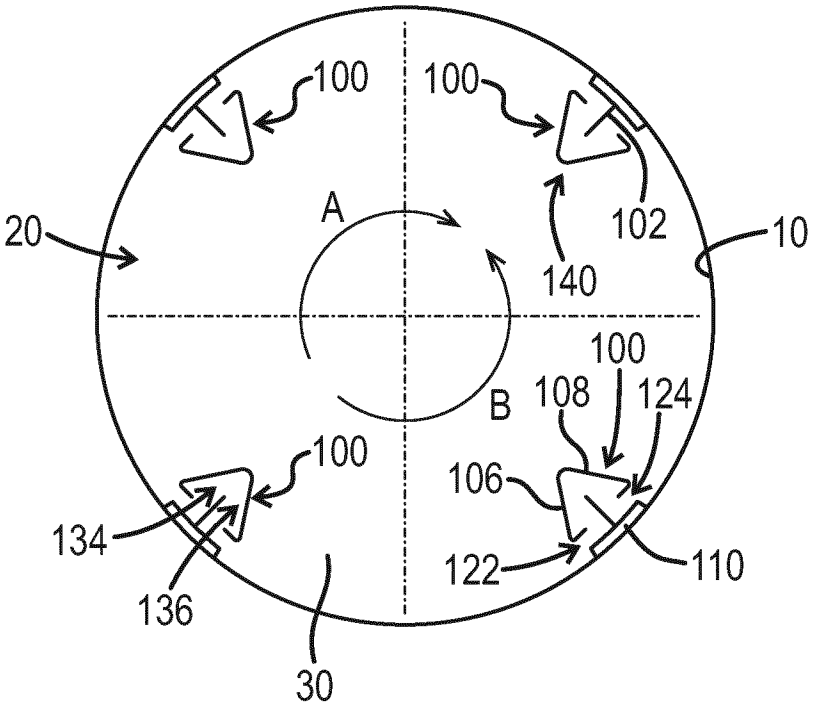
FIG. 2 illustrates a schematic cross-section of another drum of the apparatus of the present invention.

The Features Described in the Following Passages Relate to all Aspects and Embodiments Described Above Unless Stated Otherwise:

Said first elongate protrusions, said second elongate protrusions and the lifters of the present invention may be referred to generally herein as "elongate protrusions".

A first collecting flow path is defined as a flow path of solid particulate material from a first collecting aperture to the storage means. A first collecting aperture defines the start of a first collecting flow path. Solid particulate material enters said first collecting flow path from the interior of the drum via a first collecting aperture. A first collecting flow path is in fluid communication with the storage means, and preferably there is no valve separating a first collecting flow path and the storage means.

Similarly, a second collecting flow path is defined as a flow path of solid particulate material from a second collecting aperture to the storage means. A second collecting aperture defines the start of a second collecting flow path. Solid particulate material enters said second collecting flow path from the interior of the drum via a second collecting aperture. A second collecting flow path is in fluid communication with the storage means, and preferably there is no valve separating a second collecting flow path and the storage means.

Preferably, whether solid particulate material is in said first collecting flow path or said second collecting flow path is determined by the collecting aperture through which the solid particulate material entered. For instance, solid particulate material that enters through a first collecting aperture travels to the storage means via said first collecting flow path, and solid particulate material that enters through a second collecting aperture travels to the storage means via said second collecting flow path.

Preferably, said first collecting flow path and/or said second collecting flow path comprises a series of deflectors which are configured to urge said solid particulate material towards said storage means during rotation of said drum. Preferably, said first collecting flow path and/or said second collecting flow path further comprises a plurality of series of deflectors which are configured to urge said solid particulate material towards said storage means during rotation of said drum. Preferably, said first collecting flow path and/or said second collecting flow path comprises a first series of deflectors which are configured to urge said solid particulate material towards said storage means during rotation of said drum and a second series of deflectors which are configured to urge said solid particulate material towards said storage means during rotation of said drum. Preferably said first lengthwise portion and said second lengthwise portion of said first embodiment of said first elongate protrusion and/or said lifter comprise a series of deflectors or a plurality of series of deflectors as described herein.

Preferably, said series of deflectors, or each series of said plurality of series of deflectors, are inclined substantially parallel to each other. In this context, the term "substantially parallel" means that the respective deflectors make an angle with each other which is less than about 20°, preferably less than about 10°, preferably less than about 5°. Preferably, a series of deflectors in a plurality of series of deflectors are inclined substantially parallel to each other but are not substantially parallel to deflectors in other series of deflectors.

Preferably, said first collecting flow path and/or said second collecting flow path comprises a chain of open compartments which are configured to urge said solid particulate material towards said storage means during rotation of said drum. Preferably said first lengthwise portion and said second lengthwise portion of said first embodiment of said first elongate protrusion and/or said lifter comprise a chain of open compartments which are configured to urge said solid particulate material towards said storage means during rotation of said drum.

Preferably, said first collecting flow path and/or said second collecting flow path is or comprises an Archimedean screw arrangement. Preferably, said first lengthwise portion and said second lengthwise portion of said first embodiment of said first elongate protrusion and/or said lifter comprise an Archimedean screw arrangement. Typically, said Archimedean screw arrangement may comprise surfaces that are rectilinear or curvilinear or a combination thereof.

In a preferred embodiment, said first and second collecting flow path is or comprises an Archimedean screw arrangement which is located in said first elongate protrusion or said lifter of the invention. Alternatively, said first collecting flow path is or comprises an Archimedean screw arrangement which is located in said first elongate protrusion, and said second collecting flow path is or comprises an Archimedean screw arrangement which is located in said second elongate protrusion. As the drum is rotated in the collecting direction, the solid particulate material within said first and/or second collecting flow path is urged by the internal surfaces of the Archimedean screw along the collecting flow path and towards the storage means. Thus, as a result only of the rotation of the drum, the solid particulate material may be conveyed from the collecting aperture and/or collecting flow path to the storage means.

Preferably, the first elongate protrusion or said lifter comprises a pair of Archimedean screws, wherein the Archimedean screws are oppositely handed, that is, one of the pair of Archimedean screws has a clockwise path whereas the other pair of Archimedean screws has a counter-clockwise path.

Preferably, each screw pitch of said Archimedean screw arrangement is associated with a first or a second collecting aperture. Similarly, each open compartment in said chain of open compartments is associated with a first or a second collecting aperture.

Where said first elongate protrusion, second elongate protrusion and/or lifter as described above has a plurality of collecting apertures, preferably said first elongate protrusion, second elongate protrusion and/or lifter comprises a plurality of corresponding collecting flow paths. For instance, each of said first collecting flow paths starts at one of said plurality of first collecting apertures and then unites with other first collecting flow paths to form a single common first collecting flow path in said first elongate protrusion or said lifter, wherein said single common first collecting flow path is in fluid communication with said storage means. Preferably, said single common first collecting flow path comprises a chain of open compartments or Archimedean screw arrangement as described herein. Preferably, each of said second collecting flow paths starts at one of said plurality of second collecting apertures and then unites with other second collecting flow paths to form a single common second collecting flow path in said first and/or second elongate protrusion or lifter, wherein said single common second collecting flow path is in fluid communication with said storage means. Preferably, said single common second collecting flow path comprises a chain of open compartments or Archimedean screw arrangement as described herein.

Preferably, one of said first or second collecting flow paths is or comprises a substantially clockwise path and the other of said first and second collecting flow paths is or comprises a substantially counter-clockwise path.

Preferably, movement of said solid particulate material between the interior of the drum and the storage means is actuated entirely by rotation of the drum. It will be appreciated that the term "actuated entirely by rotation of the drum" means that said movement of said particulate material is effected by the rotation of the drum and also affected by gravity. In particular, it will be appreciated that the term "actuated entirely by rotation of the drum" means that said movement of said solid particulate material between the storage means and the interior of the drum does not require a pump.

In the apparatus of the present invention, a first collecting flow path and a second collecting flow path are different flow paths. The first collecting flow path and the second collecting flow path may be partially but not completely coextensive. In other words, a portion (but not the entirety) of a first collecting flow path may occupy the same space as a portion of a second collecting flow path.

Preferably, said first and second collecting flow paths are constituted by the walls of a series of separate modular sections wherein each of said modular sections comprises a collecting aperture and a portion of said first and/or second collecting flow paths, wherein said series of separate modular sections, when joined together, form at least some of the boundary walls of said first and second collecting flow paths. Preferably, said modular sections form the internal walls of said first and/or second elongate protrusion, i.e. the walls of said first and/or second collecting flow paths, rather than the outer walls of the elongate protrusion which contact the substrates in the interior of the drum. A modular arrangement has the advantage of easier and more economic manufacturing, for instance by injection moulding. Preferably the modular sections in this embodiment are joined together linearly, preferably by means of a tie-bar which extends from the first to the last modular section. The assembly comprising the tie-bar and joined modular sections are suitably covered by the outer skin of the elongate protrusion (typically a stainless steel outer skin), which extends from the proximate end to the distal end thereof. Thus, the tie bar is suitably located within said first and/or second elongate protrusion, or lifter, preferably within the lobe which is most remote from the inner surface of the drum, or juxtaposed with the trailing edge of the elongate protrusion or lifter during rotation of the drum in a collecting direction.

Said Archimedean screw may be motorised but preferably the inner surfaces of the Archimedean screw are static, relative to the inner wall of the drum, i.e. the inner surfaces of the Archimedean screw preferably do not rotate independently of the rotation of the drum.

The inner surfaces of the Archimedean screw suitably have a conventional circular and/or smooth arrangement. Alternatively or additionally, the Archimedean screw is rectilinear, having stepped surfaces along at least a part of its length. Similarly, while the cross-section of an Archimedean screw is suitably circular, other cross-sections are envisaged, and particularly multi-lobal cross-sections, such as tri-lobal or quadri-lobal. A trilobal cross-section is of particular utility because the elongate protrusions within which the Archimedean screw is disposed are typically triangular in cross-section; hence a trilobal cross-section for the Archimedean screw makes the best possible use of the space available inside the elongate protrusion. Rectilinear arrangements are of particular utility because the elongate protrusion, or lifter, may be manufactured in multiple pieces and assembled together to form the flow paths discussed hereinabove in said first elongate protrusion, second elongate protrusion or lifter. Suitable manufacturing processes include injection moulding.

In another preferred embodiment, referred to herein as the paternoster configuration, said chain of open compartments are formed by a first series of inclined vanes substantially parallel to each other and a second series of inclined vanes substantially parallel to each other. In this context, the term "substantially parallel" means that the respective vanes make an angle with each other which is less than about 20°, preferably less than about 10°, preferably less than about 5°.

Preferably, said first and second series are disposed along at least part of the length of the interior of said first and/or second elongate protrusion or lifter. Said first series of vanes may be disposed in a facing arrangement to said second series of vanes, wherein said first series of vanes are not parallel to said second series of vanes, and wherein the compartments and vanes are configured to bias solid particulate material present inside said first and/or second collecting flow path towards said storage means during rotation of the drum in a first and/or second collecting direction.

In a further preferred embodiment, said chain of open compartments is formed by opposing and offset saw-tooth surfaces configured to bias solid particulate material present inside said first and/or said second collecting flow path towards said storage means during rotation of the drum.

Optionally, said first elongate protrusion, said second elongate protrusion and/or said lifter may comprise one or more perforations which have dimensions smaller than the smallest dimension of the solid particulate material so as to permit passage of fluids through said perforations but to prevent passage of said solid particulate material through said perforations.

The first and/or second elongate protrusion, or lifter, may comprise an aperture in which a tie bar can be located. The aperture may be located proximal to the top portion of the elongate protrusion. The first and second collecting flow paths may be located radially outward of the tie bar aperture, i.e. distally from the centre of the drum relative to the tie bar. This arrangement may provide increased stiffness for the drum and may allow for an elongate protrusion of reduced width. Having an elongate protrusion with narrow width, and preferably also rounded shaping, provides advantageous movement, especially tumbling, of the substrate, the solid particulate material and liquid medium, where present. If the elongate protrusion is too wide it reduces the available volume within the drum and, therefore, reduces the available batch volume or washload for the treatment cycle. An elongate protrusion having a substantially triangular cross-section with a curved top portion is particularly preferred.

The specific nature of the first collecting flow path which solid particulate material follows on passing through a first collecting aperture may depend on the particular location of the first collecting aperture through which the solid particle material has passed. For example, solid particulate material that passes through a first collecting aperture that is positioned along the elongate protrusion at a position distal to the end wall may follow a first collecting flow path that is longer and/or more tortuous than the first collecting flow path followed by solid particulate material that passes through a first collecting aperture closer to the end wall of the drum. Similarly, where said first elongate protrusion and/or said second elongate protrusion comprises a plurality of said second collecting apertures disposed in said second side, the specific nature of the second collecting flow path which solid particulate material follows on passing through a second collecting aperture may depend on the particular location of the second collecting aperture through which the solid particle material has passed. For example, solid particulate material that passes through a second collecting aperture that is positioned along the elongate protrusion at a position distal to the end wall may follow a second collecting flow path that is longer and/or more tortuous than the second collecting flow path followed by solid particulate material that passes through a second collecting aperture closer to the end wall of the drum.

The first collecting flow path may comprise a plurality of types of first collecting flow path. Preferably, the first collecting flow path comprises a first type of first collecting flow path and a second type of first collecting flow path. Alternatively or in addition, the second collecting flow path may comprise a plurality of types of second collecting flow path. Preferably, the second collecting flow path comprises a first type of second collecting flow path and a second type of second collecting flow path.

Said first elongate protrusion may comprise a first portion having a first set of first collecting apertures, wherein each first collecting aperture in said first set of first collecting apertures defines the start of a first type of first collecting flow path, and a second portion having a second set of first collecting apertures, wherein each first collecting aperture in said second set of first collecting apertures defines the start of a second type of first collecting flow path. Typically, each of said first type of first collecting flow paths starts at one of said first collecting apertures in said first set of first collecting apertures and then unites with other first type of first collecting flow paths along at least part of its flow path to form a partially common first type of first collecting flow path in said first elongate protrusion or said lifter, wherein said partially common first type of first collecting flow path is in fluid communication with said storage means. Each of said second type of first collecting flow paths may start at one of said first collecting apertures in said second set of first collecting apertures and then unite with other second type of first collecting flow paths to form a single common second type of first collecting flow path in said first elongate protrusion or said lifter, wherein said single common second type of first collecting flow path is in fluid communication with said storage means. Typically, said first elongate protrusion may comprise an internal structure that varies the nature of the first collecting flow path followed by solid particulate material depending on the location of the first collecting aperture through which the solid particulate material has passed. For example, said first set of first collecting apertures may define the start of a first type of first collecting flow path that is or comprises a chain of open compartments or an Archimedean screw arrangement as described herein, and said second set of first collecting apertures may define the start of a second type of first collecting flow path that is or comprises a compound arcuate or helicoidal path. Preferably, said first set of first collecting apertures is positioned in the elongate protrusion distal to the end wall of the drum whereas the second set of first collecting apertures is positioned nearer to the end wall of the drum. More preferably, the second set of first collecting apertures is positioned adjacent the end wall of the drum. In this way, the second type of first collecting flow path may be shorter and/or less tortuous than the first type of first collecting flow path. An advantage of this arrangement may be faster and more efficient collection of solid particulate material, particularly during an initial stage of collection of solid particulate material from the drum. This arrangement may be particularly advantageous where the rotational axis of the drum is inclined relative to the horizontal direction such that solid particulate material is biased towards the end wall of the drum under the influence of gravity.

Alternatively or in addition, said first elongate protrusion and/or said second elongate protrusion may comprise a first portion having a first set of second collecting apertures, wherein each second collecting aperture in said first set of second collecting apertures defines the start of a first type of second collecting flow path, and a second portion having a second set of second collecting apertures, wherein each second collecting aperture in said second set of second collecting apertures defines the start of a second type of second collecting flow path. Typically, each of said first type of second collecting flow paths starts at one of said second collecting apertures in said first set of second collecting apertures and then unites with other first type of second collecting flow paths along at least part of its flow path to form a partially common first type of second collecting flow path in said elongate protrusion, wherein said partially common first type of second collecting flow path is in fluid communication with said storage means. Each of said second type of second collecting flow paths may start at one of said second collecting apertures in said second set of second collecting apertures and then unite with other second type of second collecting flow paths to form a single common second type of second collecting flow path in said elongate protrusion, wherein said single common second type of second collecting flow path is in fluid communication with said storage means. Typically, said first elongate protrusion and/or said second elongate protrusion may comprise an internal structure that varies the nature of the second collecting flow path followed by solid particulate material depending on the location of the second collecting aperture through which the solid particulate material has passed. For example, said first set of second collecting apertures may define the start of a first type of second collecting flow path that is or comprises a chain of open compartments or an Archimedean screw arrangement as described herein, and said second set of second collecting apertures may define the start of a second type of second collecting flow path that is or comprises a compound arcuate or helicoidal path. Preferably, said first set of second collecting apertures is positioned in the elongate protrusion distal to the end wall of the drum whereas the second set of second collecting apertures is positioned nearer to the end wall of the drum. More preferably, the second set of second collecting apertures is positioned adjacent the end wall of the drum. In this way, the second type of second collecting flow path may be shorter and/or less tortuous than the first type of second collecting flow path. An advantage of this arrangement may be faster and more efficient collection of solid particulate material, particularly during an initial stage of collection of solid particulate material from the drum. This arrangement may be particularly advantageous where the rotational axis of the drum is inclined relative to the horizontal direction such that solid particulate material is biased towards the end wall of the drum under the influence of gravity.

The term "set" as used herein in relation to the first collecting apertures, can refer to a single first collecting aperture or a plurality of first collecting apertures. The term "set" as used herein in relation to the second collecting apertures, can refer to a single second collecting aperture or a plurality of second collecting apertures.

Preferably, said second set of first collecting apertures and/or said second set of second collecting apertures define a second type of first collecting flow path and a second type of second collecting flow path, respectively, that comprise a compound arcuate or helicoidal path. Independently of each other, the second type of first collecting flow path and the second type of second collecting flow path may direct solid particulate material in a curved path, generally moving the solid particulate material radially inwards, then axially and optionally radially outwards towards the end wall of the drum. This arrangement is particularly preferred when said second set of first collecting apertures and said second set of second collecting apertures is positioned nearer to the end wall of the drum than said first set of first collecting apertures and said first set of second collecting apertures, respectively. In this way, the second type of first collecting flow path and the second type of second collecting flow path may be significantly shorter than said first type of first collecting flow path and/or said first type of second collecting flow path.

The second type of first collecting flow path and the second type of second collecting flow path may each comprise a first surface, an edge of the first surface may be located adjacent to the second set of first collecting apertures or said second set of second collecting apertures, respectively. The curvature of the first surface may comprise a radius the centre axis of which may be approximately parallel to the centreline axis of the elongate protrusion. The radius of curvature of the first surface may increase towards the end wall of the drum and decrease away from the end wall of the drum. The second type of first collecting flow path and/or the second type of second collecting flow path may each comprise a second surface. The second surface may be arranged to receive solid particulate material from the first surface and direct solid particulate material to the storage means. As the elongate protrusion moves as the drum rotates, solid particulate material may be transferred from the first surface to the second surface. The second surface may direct the solid particulate material into the storage means via an aperture in the end wall of the drum. The second surface may be planar or curved and may optionally be angled radially outwards from the centre of the drum.

Said second type of second collecting flow path may comprise an opposing configuration to the second type of first collecting flow path. For example, the second type of second collecting flow path may comprise a flow path arranged as a mirror image of the second type of first collecting flow path.

The first type of first collecting flow path and the second type of first collecting flow path may be partially but not completely coextensive. In other words, a portion (but not the entirety) of a first type of first collecting flow path may occupy the same space as a portion of a second type of first collecting flow path. Alternatively, and preferably, the first type of first collecting flow path and the second type of first collecting flow path may be entirely separate.

Alternatively or in addition, the first type of second collecting flow path and the second type of second collecting flow path may be partially but not completely coextensive. In other words, a portion (but not the entirety) of a first type of second collecting flow path may occupy the same space as a portion of a second type of second collecting flow path. Alternatively, and preferably, the first type of second collecting flow path and the second type of second collecting flow path may be entirely separate.

Said second type of first collecting flow path and/or said second type of second collecting flow path may be positioned radially outwards of said first type of first collecting flow path and said first type of second collecting flow path (i.e. distal from the centre of the drum). The first type of first collecting flow path and said first type of second collecting flow path may be directed radially inwards by an extended surface adjacent to an aperture of the storage means which extends radially inwards to a greater extent than the preceding flow path. Typically, the extended surface is adjacent to the aperture of the storage means.

Typically, the second set of first collecting apertures may extend along a portion that is from about 2% to about 50% of the length of the first side of the elongate protrusion, or from about 5% to about 30%, or from about 7% to about 25%, or from about 10% to about 20%, or a range of any combination of the aforesaid end points. The portion of the first side of the elongate protrusion not comprising said second set of first collecting apertures may comprise said first set of first collecting apertures.

Alternatively, or in addition, the second set of second collecting apertures may extend along a portion that is from about 2% to about 50% of the length of the second side of the elongate protrusion, or from about 5% to about 30%, or from about 7% to about 25%, or from about 10% to about 20%, or a range of any combination of the aforesaid end points. The portion of the second side of the elongate protrusion not comprising said second set of second collecting apertures may comprise said first set of second collecting apertures.

Said first elongate protrusion may be arranged such that solid particulate material that follows said first type of first collecting flow path may be urged towards the storage means regardless of the direction of rotation of said drum whereas said solid particulate material in said second type of first collecting flow path is urged towards the drum only in said first collecting direction.

Alternatively or in addition, said first elongate protrusion and/or said second elongate protrusion or lifter may be arranged such that solid particulate material that follows said first type of second collecting flow path may be urged towards the storage means regardless of the direction of rotation of said drum whereas said solid particulate material in said second type of second collecting flow path is urged towards the drum only in said second collecting direction.

Storage Means

The storage means may take a variety of forms and the drum may comprise storage means at one or more locations.

In a preferred embodiment, the storage means comprises multiple compartments, for instance, 2, 3, 4, 5 or 6 compartments, particularly wherein said multiple compartments are arranged so as to retain balance of the drum during rotation, preferably such that said multiple compartments are equi-spaced and arranged symmetrically around the rotational axis of the drum. Preferably, each of said multiple compartments is associated with a single elongate protrusion as described herein. Where said elongate protrusion is a bi-directional elongate protrusion, preferably said elongate protrusion is positioned on the inner surface of said drum such that it sits in a central portion of said compartment.

The capacity of the storage means will vary with the size of the drum and the amount of solid particulate material. Preferably the capacity of the storage means is from about 20 to about 50%, preferably from about 30 to about 40%, larger than the volume of the solid particulate material. In this context, the term "volume of solid particulate material" preferably refers to the volume occupied by solid particulate material when packed randomly (i.e. including the spaces around each particle of the multiplicity of particles when in packed form in the storage means). Thus, a washing machine for domestic use would typically require about 8 litres of solid particulate material, and an appropriate storage means for such a machine has a capacity of about 11 litres.

In one particularly useful embodiment, the storage means and the elongate protrusions can be assembled together inside the drum and/or are able to be retrofitted to an existing drum. This arrangement is of particular utility in converting a conventional apparatus which is not suitable or adapted for the treatment of substrates using a solid particulate material into an apparatus which is suitable for the treatment of substrates using a solid particulate material. In this embodiment, the storage means and the elongate protrusions would normally be non-integral elements, in order to allow these components to be introduced into the drum without dissembling the whole apparatus. However, integral storage means and elongate protrusions are also envisaged.

In a further particularly useful embodiment, the storage means and the elongate protrusions are removable and replaceable, either by the consumer or by a service engineer. In this embodiment, the storage means and the elongate protrusions would normally be non-integral elements, in order to allow these components to be introduced into the drum without dissembling the whole apparatus. However, integral storage means and elongate protrusions are also envisaged. One advantage of this embodiment is that it allows convenient replacement of the solid particulate material. Thus, solid particulate material located within the storage means and/or elongate protrusions may be removed at the same time as the storage means and/or elongate protrusions, and replaced with fresh solid particulate material contained in the replacement storage means and/or elongate protrusions. Alternatively, solid particulate material may be replaced by operating the apparatus (normally by a cycle determined by pre-programmed instructions stored in the control means of the apparatus) such that solid particulate material is dispensed into an empty drum by rotating the drum in the manner described herein, and then manually removed by a service engineer, wherein fresh solid particulate material is then manually loaded into the empty drum by a service engineer and the apparatus then operated (normally by a cycle determined by pre-programmed instructions stored in the control means of the apparatus) such that solid particulate material is collected from the drum and passed into the storage means via said elongate protrusions by rotating the drum in the manner described herein. Thus, it is not necessary to replace the storage means and/or elongate protrusions just to replace the solid particulate material.

In a particularly preferred embodiment, at least part of (and preferably all of) the storage means is or comprises at least one cavity located in the end wall of the drum. It will be appreciated that the term "located in the end wall of the drum" describes a storage means which is integral with, or affixed or disposed on, any part of the structure of the end wall. Thus, in the retro-fitting embodiment described herein, the storage means are disposed or affixed onto the existing end wall of an existing drum. The outer surface of the retrofitted storage means which faces towards the interior of the drum thus creates a new interior surface, which is different to the original interior surface of the original end wall prior to retro-fitting, but it will be appreciated that this new interior surface is treated for the purposes of this invention as being the interior surface of the new end wall of the drum. In other words, the retro-fitted storage means becomes part of the element which is described herein as the "end wall of the drum". Similarly, storage means may be also present on or retro-fitted to the exterior surface of an end wall of the drum which faces the casing of the apparatus, and for the purposes of the present invention such a storage means is also treated as "located in the end wall of the drum".

Thus, the storage means may be or comprise at least one spiral or helical pathway located in the end wall of the drum.

In another preferred embodiment, the storage means is or comprises a toroidal cavity located at the juncture of the inner surface and end wall of the drum, or wherein the storage means is or comprises a cavity having a shape defined by a toroidal segment located at the juncture of said inner surface and said end wall. It will be appreciated that such a storage means does not fall within the meaning of "located in the end wall of the drum" as used herein.

The storage means may comprise multiple parts, preferably from 2 to 8 parts, and for domestic washing machine preferably 2, 3 or 4 parts, which advantageously can be assembled inside the drum and/or which is able to be retrofitted to an existing drum.

In a most preferred embodiment, the storage means comprises multiple compartments or cavities located in the end wall of the drum, as described above. Preferably, each of the compartments in such a multi-compartment arrangement is defined by a cavity bound by a first wall and a second wall which each extend substantially radially outwards from the rotational axis of the drum towards, and preferably extend to, the inner wall of the drum. The drum is normally cylindrical, and so preferably each compartment substantially defines a sector of a cylindrical storage volume in the end wall of drum.

Preferably, each compartment in the multi-compartment arrangement is adjacent another compartment, preferably so that the compartments define adjacent such sectors which fill or substantially fill a cylindrical storage volume in the end wall of drum. As used herein, the terms "extend substantially radially outwards" and "substantially defines a sector" means that said first wall and/or said second wall of said cavity need not follow a straight line defining the mathematical radius, i.e. a straight line extending radially outwards from the rotational axis towards and preferably to the inner wall of the drum, but said first wall and/or said second wall of said cavity may also follow a curvilinear path which extends outwards from the rotational axis of the drum towards and preferably to the inner wall of the drum. Preferably, each compartment in the multi-compartment arrangement is associated with a single elongate protrusion.

In the multi-compartment embodiment, it is preferred that at least one pair of adjacent compartments are in fluid communication. Preferably, each compartment is in fluid communication with its adjacent compartment or compartments. As used herein, the term "fluid communication" means that solid particulate material, as well as any liquid medium, is able to pass from one compartment directly into an adjacent compartment or compartments during rotation of the drum. Such an arrangement advantageously minimises or avoids the tendency for aggregation of solid particulate material which has been contacted with the liquid medium, i.e. it minimises or avoids the tendency of moist or wet solid particulate material to aggregate or clump together in the storage means, which can cause at least partial blockage of the collecting flow path and/or the dispensing flow path. Such an arrangement also provides an improvement in the collection efficiency of the solid particulate material. Such an arrangement advantageously creates more space in the storage means at the point(s) where the storage means meet the collecting and/or dispensing flow paths. Such an arrangement can also advantageously improve the balance of the drum during rotation. The fluid communication between adjacent compartments is preferably effected by an aperture, hereinafter referred to as a communicating aperture, in the wall between adjacent compartments. Such a communicating aperture preferably exhibits a smallest dimension which is at least 4 times greater than the longest dimension of the solid particulate material. The largest dimension of the communicating aperture is suitably appropriate to retain the individual nature of the compartments and, as such, the largest dimension of the communicating aperture is preferably no greater than 50%, preferably no greater than 40%, preferably no greater than 30%, preferably no greater than 20%, preferably no greater than 15%, of the longest dimension of a wall between adjacent compartments. A communicating aperture is preferably located in a wall between adjacent compartments approximately midway between the rotational axis and the inner wall of the drum. As used herein, the term "approximately midway" means any position along a wall between adjacent compartments that is closer to the mid-point of said wall between adjacent compartments than to either the rotational axis of the drum or the inner wall of the drum. For instance, where each compartment defines a sector of a cylindrical storage volume in the end wall of the drum, the mid-point of a wall between adjacent compartments is half the radius of the drum. Preferably, a communicating aperture in a wall between adjacent compartments is located at said mid-point.

Suitably, the storage means further comprises one or more perforations which have dimensions smaller than the smallest dimension of the solid particulate material so as to permit passage of fluids through said perforations into and out of the storage means, particularly from or into the interior of said drum respectively, but to prevent egress of said solid particulate material through said perforations. The presence of such perforations is advantageous for the cleaning and general hygiene of the interior of the storage means.

Said first collecting flow path may comprise a valve, preferably a one-way flap valve, to prevent egress of solid particulate material from the storage means back into said first collecting flow path during rotation of the drum in a second collecting direction. Similarly, said second collecting flow path may comprise a valve, preferably a one-way flap valve, to prevent egress of solid particulate material from the storage means back into said second collecting flow path during rotation of the drum in a first collecting direction. Advantageously, such a valve helps ensure the storage means is filled as efficiently as possible. The flap valve may be biased with a spring, and/or be mechanically controlled with a cam, and/or be gravity-operated and comprise therein a sufficient weight, in order to prevent egress of solid particulate material from said storage means to said first and/or second collecting flow path and hence into the interior of the drum. The flap valve may be an "L" shaped valve that can be configured such that it opens one flow path while closing another flow path.

Preferably, the apparatus of the present invention comprises a delivery duct in fluid communication between said first collecting flow path and/or said second collecting flow path and a compartment of said storage means, wherein said delivery duct is configured to transfer said solid particulate material from said first collecting flow path and/or said second collecting flow path to said compartment of said storage means, preferably such that entry of said solid particulate material into said compartment occurs when said compartment is oriented so as to reduce the amount of solid particulate material already in said compartment that is adjacent the point of entry into the compartment compared to the amount of solid particulate material adjacent the point of entry when said compartment is in other orientations during rotation of said drum. Preferably, entry of said solid particulate material into said compartment occurs when at least a portion of said compartment is above the horizontal plane bisecting the axis of drum rotation. As the amount of solid particulate material in a compartment of a storage means increases, the amount of free space remaining in the compartment reduces. As such, it can become increasingly difficult for additional solid particulate material to enter a compartment of a storage means. By having an apparatus further comprising a delivery duct, as described herein, the flow of solid particulate material into said compartment of said storage means can be regulated. In particular, the delivery duct can enable solid particulate material from said first collecting flow path and/or said second collecting flow path to enter a compartment of said storage means at a point in the rotation of the drum where existing solid particulate material in said compartment has fallen under gravity to a lower region of said compartment and hence facilitates the flow of solid particulate material into remaining empty space in said compartment, typically in an upper region of said compartment.

Preferably, said delivery duct is configured to be located around a portion of the circumference of the end wall of the drum.

Preferably, said delivery duct comprises a first entry aperture and a first exit aperture, wherein the first entry aperture is in fluid communication with said first collecting flow path and/or said second collecting path and is configured such that solid particulate material is able to enter the delivery duct through the first entry aperture and pass through the delivery duct as the drum rotates in said first collecting direction before passing through the first exit aperture and into a compartment of the storage means.

Preferably, said delivery duct further comprises a second entry aperture and a second exit aperture, wherein the second entry aperture is in fluid communication with said first collecting flow path and/or said second collecting flow path and is configured such that solid particulate material is able to enter the delivery duct through the second entry aperture and pass through the delivery duct as the drum rotates in said second collecting direction before passing through the second exit aperture and into a compartment of the storage means.

Preferably, said first entry aperture and said second entry aperture are the same aperture. In this way, said delivery duct comprises a common entry aperture for said first collecting flow path and said second collecting flow path.

Preferably, the delivery duct further comprises:

(a) a central portion comprising said first and second entry apertures;

(b) a first arm extending from said central portion in a first direction around the circumference of said end wall to a first end of said delivery duct; and (c) a second arm extending from said central portion in a second direction around the circumference of said end wall to a second end of said delivery duct, wherein said first exit aperture is adjacent said first end and said second aperture is adjacent said second end.

Where said compartment of said storage means is defined by a cavity bound by a first wall and a second wall which each extend substantially radially outwards from the rotational axis of the drum towards, and preferably extend to, the inner wall of the drum, said delivery duct is preferably positioned such that said first exit aperture is adjacent the first wall of the compartment and said second exit aperture is adjacent the second wall of the compartment.

Preferably, said delivery duct comprises a first arrangement of one or more baffles configured to regulate the flow of solid particulate material that nears the first exit aperture of the delivery duct, preferably when said first exit aperture is below the horizontal plane bisecting the axis of drum rotation, as the drum rotates in said first collecting direction, and wherein said first arrangement of one or more baffles is further configured to allow said solid particulate material to pass through the first exit aperture and enter the compartment of the storage means when said compartment is oriented so as to reduce the amount of solid particulate material already in said compartment that is adjacent the point of entry into the compartment compared to the amount of solid particulate material adjacent the point of entry when said compartment is in other orientations during rotation of said drum. Preferably, said first arrangement of one or more baffles is configured to allow solid particulate material to pass through the first exit aperture and enter the compartment when the first exit aperture moves above the horizontal plane bisecting the axis of drum rotation as the drum rotates in said first collecting direction.

Preferably, said first arrangement of baffles comprises a first baffle that is configured to discourage, preferably to prevent, solid particulate material that has passed said first baffle when travelling through the delivery duct towards the storage means from returning back towards the first and/or second collecting flow path as the drum rotates in said first collecting direction. Preferably, said first arrangement of baffles comprises a second baffle configured to urge towards said compartment the solid particulate material that has passed said first baffle when the first exit aperture moves above the horizontal plane bisecting the axis of drum rotation as the drum rotates in said first collecting direction.

Preferably, said delivery duct comprises a second arrangement of one or more baffles configured to regulate the flow of solid particulate material that nears the second exit aperture of the delivery duct, preferably when said second exit aperture is below the horizontal plane bisecting the axis of drum rotation, as the drum rotates in said second collecting direction, and wherein the second arrangement of one or more baffles is further configured to allow said solid particulate material to pass through said second exit aperture and enter the compartment of the storage means when said compartment is oriented so as to reduce the amount of solid particulate material already in said compartment that is adjacent the point of entry into the compartment compared to the amount of solid particulate material adjacent the point of entry when said compartment is in other orientations during rotation of said drum. Preferably, said second arrangement of one or more baffles is configured to allow solid particulate material to pass through the second exit aperture and enter the compartment when said second exit aperture moves above the horizontal plane bisecting the axis of drum rotation as the drum rotates in said second collecting direction.

Preferably, said second arrangement of baffles comprises a first baffle that is configured to discourage, preferably to prevent, solid particulate material that has passed said first baffle when travelling through the delivery duct towards the storage means from returning back towards the first and/or second collecting flow path as the drum rotates in said second collecting direction. Preferably, said second arrangement of baffles comprises a second baffle configured to urge towards said compartment the solid particulate material that has passed said first baffle when the first exit aperture moves above the horizontal plane bisecting the axis of drum rotation as the drum rotates in said second collecting direction.

Preferably, the drum comprises a plurality of delivery ducts. Preferably, each elongate protrusion as defined herein that is affixed to the inner surface of said drum is in fluid communication with a delivery duct. Preferably, each compartment of said storage means is in fluid communication with a delivery duct. Preferably, a single delivery duct is associated with a single compartment of said storage means. Additionally or alternatively, a single delivery duct is preferably associated with a single first or second elongate protrusion or single lifter as defined herein.

The apparatus may comprise a dispensing aperture and a dispensing flow path for facilitating flow of said solid particulate material from said storage means to the interior of said drum. Preferably said dispensing aperture is comprised in the end wall of said drum. Preferably, said drum comprises a valve that is actuatable between a closed position and an open position, wherein when said valve is in said closed position said solid particulate material is prevented from passing through said dispensing aperture and when said valve is in said open position said solid particulate material is permitted to pass through said dispensing aperture.

The valve may be actuatable between said closed position and said open position via any appropriate arrangement. When the valve is in the closed position, solid particulate material is prevented from passing through the dispensing aperture. In this way, when the valve is in the closed position, the drum can be rotated in a clockwise direction and in a counter-clockwise direction without any solid particulate material being released from said storage means. When the valve is in said open position, solid particulate material is permitted to pass through said dispensing aperture.

Preferably, the valve may be actuatable between said closed position and a plurality of open positions. For instance, the valve may be actuated to a first open position where solid particulate material is permitted to pass through said dispensing aperture but where the position of said valve relative to said dispensing aperture allows a relatively low rate of dispensing of solid particulate material. The valve may additionally be actuated to a second open position where solid particulate material is permitted to pass through said dispensing aperture but where the position of said valve relative to said dispensing aperture allows a relatively high rate of dispensing of solid particulate material. It will be appreciated that adjustment of the rate of dispensing of said solid particulate material may be achieved by actuating said valve between a plurality of open positions.

Preferably, the valve is actuatable between said closed position and said open position via a shaft, such as a rod. Preferably, the shaft sits within and is aligned with a drive shaft of the drum.

Preferably, said shaft is substantially aligned with the rotational axis of said drum. In this context, the term "substantially aligned" means that the shaft makes an angle with the rotational axis of the drum which is less than about 20°, preferably less than about 10°, preferably less than about 5°. Preferably, the shaft is co-axial with the rotational axis of the drum.

The valve may be manually actuatable. For instance, a user of the apparatus may be able to push in and pull out one end of a shaft and thereby move the valve between the open and closed positions Alternatively, or in addition, said valve may be mechanically actuatable.

Preferably, said valve is electromechanically actuatable, in particular using a solenoid or a lead screw. The valve may be actuated remotely, for example, using a magnetic field or using a wireless signal.

Preferably, said valve is actuated using a lead screw, also known as a power screw or translation screw. Lead screws are able to translate rotational motion into linear motion. An advantage of actuating said valve using a lead screw is that the valve can be more readily actuated incrementally and/or intermittently. Furthermore, using a lead screw to actuate the valve may allow less power to be consumed because, typically, once the lead screw has been used to actuate the valve, power can be turned off and the valve will stay where it is positioned.

The valve may be any suitable size and shape such that it is able to prevent solid particulate material from passing through said dispensing aperture when the valve is in said closed position and is able to permit solid particulate material to pass through said dispensing aperture when said valve is in said open position.

Preferably, said valve is configured such that when said valve is in said open position, the minimum dimension of the opening created between said valve and said dispensing aperture is at least 2 times, preferably at least 3 times, more preferably at least 4 times the longest dimension of the solid particulate material. Typically, when said valve is in said open position, the opening created between said valve and said dispensing aperture is at least 5 mm, preferably at least 6 mm, preferably at least 7 mm, preferably at least 8 mm, preferably at least 9 mm, preferably at least 10 mm, preferably at least 11 mm, preferably at least 12 mm, preferably at least 13 mm, preferably at least 14 mm, preferably at least 15 mm, preferably at least 20 mm, preferably at least 25 mm, preferably at least 30 mm. Typically, when said valve is in said open position, the opening created between said valve and said dispensing aperture has a maximum dimension of no more than 200 mm, preferably no more than 100 mm, preferably no more than 50 mm.

Typically, said valve abuts an edge of said dispensing aperture or a surface of said end wall of said drum, to create a seal when said valve is in the closed position. For instance said valve may comprise a disk portion and a shank portion and said disk portion may form a seal with a surface of said end wall of said drum, preferably a substantially vertical surface of said end wall of said drum, when said valve is in said closed position. Alternatively, said disk portion may have a tapered edge and said dispensing aperture may comprise a corresponding tapered edge such that when the valve is in the closed position, said tapered edge of said disk portion of said valve abuts said corresponding tapered edge of said dispensing aperture to create a seal. Preferably, the tapered edge of the disk portion and/or the dispensing aperture is shaped such that accumulation or retention of solid particulate material, which could otherwise prevent closure of the valve, is discouraged. For instance, the tapered edge of the disk portion and/or the dispensing aperture may be angled with respect to the horizontal plane. Preferably, said angle is at least 45°, preferably at least 60°, preferably at least 70°, preferably at least 80° with respect to the horizontal plane. For curved tapered edges, the angle is taken at the midpoint of the curved edge.

Alternatively, said valve may be configured such that when the valve is in the closed position, it does not form a seal with an edge of said dispensing aperture or a surface of said end wall of said drum. Preferably, there is a gap between said valve and said dispensing aperture or said valve and a surface of said end wall of said drum, preferably a substantially vertical surface of said end wall of said drum, when the valve is in the closed position, wherein the size of the gap is such that solid particulate material cannot pass through. Typically, the longest dimension of the gap is less than 2 mm, preferably less than 1 mm. An advantage of having a gap between the valve and an edge of the dispensing aperture or a surface of said end wall of said drum when the valve is in the closed position is that the risk of solid particulate material causing a jamming of the valve can be reduced.

Preferably, said valve projects towards the interior of said drum when said valve is in the open position. Alternatively, preferably said valve moves away from the interior of said drum when said valve is in the open position, preferably said valve moves into said storage means. Preferably, said valve may be or form part of a poppet valve or a spring valve. Preferably, said valve is or forms part of a poppet valve.

Alternatively, said valve may be or form part of a sleeve valve. Typically, said sleeve valve comprises a cylindrical portion having a side comprising at least one port. Preferably, said sleeve valve is configured such that, on rotation, said at least one port can align with an opening in said storage means, thereby permitting passage of solid particulate material from said storage means and through said dispensing aperture into the interior of said drum.

Preferably, said dispensing aperture is located substantially centrally in said end wall of said drum. In this way, solid particulate material that passes through said dispensing aperture from said storage means to said interior of said drum may be more efficiently mixed with said substrate being treated. In particular, this arrangement may increase the amount of solid particulate material that can fall on to the top of said substrate in said interior of said drum.

Preferably, said dispensing aperture coincides with the rotational axis of said drum. Preferably, said dispensing aperture is concentric with the rotational axis of said drum. Preferably, the shape of said dispensing aperture is substantially circular or annular.

Preferably, said dispensing aperture has a minimum dimension of at least 5 mm, preferably at least 6 mm, preferably at least 7 mm, preferably at least 8 mm, preferably at least 9 mm, preferably at least 10 mm, preferably at least 11 mm, preferably at least 12 mm, preferably at least 13 mm, preferably at least 14 mm, preferably at least 15 mm, preferably at least 20 mm, preferably at least 25 mm, preferably at least 30 mm. Preferably, said dispensing aperture has a maximum dimension of no more than 300 mm, preferably no more than 200 mm, preferably no more than 100 mm, preferably no more than 50 mm. Preferably, said dispensing aperture has a minimum dimension that is at least 2 times, preferably at least 3 times, more preferably at least 4 times the longest dimension of the solid particulate material. Preferably, said dispensing aperture has a maximum dimension that is no more than 50% of the diameter of the drum, preferably no more than 25% of the diameter of the drum, preferably no more than 20% of the diameter of the drum.

Preferably, the apparatus comprises a single dispensing aperture. In arrangements where said storage means comprises multiple compartments as described hereinbelow, said single dispensing aperture is preferably in fluid communication with each of said multiple compartments.

However, in alternative embodiments, said drum may comprises a plurality of said dispensing apertures, for instance, 2, 3, 4, 5, or 6 dispensing apertures. For instance, where said storage means comprises multiple compartments as described hereinbelow, each of said plurality of dispensing apertures may be in fluid communication with a separate one of said multiple compartments.

Where the drum comprises a plurality of dispensing apertures, preferably said drum comprises a single valve. In this arrangement, said single valve is configured to interact with said plurality of dispensing apertures in order to prevent solid particulate material from passing through all of said plurality of dispensing apertures when said valve is in said closed position and to permit said solid particulate material to pass through any of said plurality of dispensing apertures when said valve is in said open position.

Alternatively, where the drum comprises a plurality of dispensing apertures, said drum may comprise a plurality of said valves. For instance, the drum may comprise a corresponding number of valves as dispensing apertures.

In arrangements where the apparatus comprises a plurality of valves, said plurality of valves may be independently actuatable. Alternatively, said plurality of valves may be jointly actuatable, for instance by using an arrangement of mechanical linkages positioned inside the storage means. Preferably, said plurality of valves are jointly actuatable by using an arrangement comprising an articulated rod. Having said plurality of valves being jointly actuatable may be advantageous because the number of seals required between the actuating means and the drum can be reduced.

Preferably, said drum comprises a baffle or deflector for regulating the flow of solid particulate material through said dispensing aperture. Preferably, said drum comprises a baffle or deflector configured to bias said solid particulate material within said storage means towards said dispensing aperture.

When said storage means comprises multiple compartments as described herein, preferably each compartment comprises a baffle or deflector or a portion of said baffle or deflector. Said drum may comprise a baffle or deflector that is in fluid communication with more than one compartment. For instance, said drum may comprise a single baffle or deflector that is in fluid communication with each of said multiple compartments. Alternatively, each of said multiple compartments may comprise a separate baffle or deflector.

Typically, when the valve is in said open position, solid particulate material passes through the dispensing aperture (s) under gravity as the drum rotates. In particular, as the drum rotates, solid particulate material in a cavity or compartment of the storage means may be rotated above the location of the dispensing aperture(s) and can fall under gravity towards, and preferably through, the dispensing aperture.

Preferably, the apparatus further comprises a guard positioned between the interior of said drum and said valve, wherein said guard comprises a plurality of apertures, wherein the plurality of apertures permit passage of solid particulate material through said guard but prevent passage of said substrates. In this way, the apparatus can prevent damage of the substrates being treated by avoiding them coming into contact with said valve and said dispensing aperture.

Preferably, said guard comprises a grill.

Preferably, the dispensing aperture is above the horizontal plane bisecting the axis of drum rotation. In this way, solid particulate material can fall on to the substrate(s) present in the interior of the drum.

The storage means may further comprise a collection chamber. Preferably, the storage means comprises a plurality of collection chambers. Preferably, the storage means comprises a separate collection chamber associated with each of the elongate protrusions. The collection chamber may comprise a first volume into which any of said first and/or second collecting flow paths may direct solid particulate material. The collection chamber may comprise one or more gates through which solid particulate material may exit the collection chamber into the storage means. The gates may be operable by mechanical actuation as the drum rotates or under the influence of gravity. In this way, flow of solid particulate material from the collection chamber to the storage means can be better controlled. The collection chamber may further comprise a secondary volume which may receive solid particulate material from a different flow path to the first volume. The secondary volume may optionally comprise one or more gates through which the solid particulate material may exit the collection chamber into the storage means. The collection chamber may receive solid particulate material from a plurality of flow paths and deliver solid particulate material into the storage means, preventing back flow of solid particulate material out of the storage means.

Dimensions and Surfaces

The dimensions of said storage means, said first collecting flow path and said second collecting flow path are preferably such that they have no internal dimension which is less than 2 times, more preferably which is less than 3 times, more preferably which is less than 4 times, the longest dimension of the solid particulate material. Similarly, the dimensions of said first collecting aperture and said second collecting aperture are preferably at least 2 times, preferably at least 3 times, more preferably at least 4 times, the longest dimension of the solid particulate material. Such dimensions help to maintain the particle flow and the speed thereof, as well as preventing blockages.

The elements of the drum which come into contact with the substrates to be treated preferably present a smooth surface to said substrates, so that the substrates do not become trapped or snag on said elements. Such elements include the inner and end walls of the drum and the elongate protrusions generally, and particularly said first collecting apertures and said second collecting apertures thereof.

The Solid Particulate Material and the Method of Treatment of Substrates Therewith The apparatus of the present invention is preferably configured for the treatment of substrates with solid particulate material in the presence of a liquid medium and/or one of more treatment formulation(s).

The solid particulate material preferably comprises a multiplicity of particles. Typically, the number of particles is no less than 1000, more typically no less than 10,000, even more typically no less than 100,000. A large number of particles is particularly advantageous in preventing creasing and/or for improving the uniformity of treating or cleaning of the substrate, particularly wherein the substrate is a textile.

Preferably, the particles have an average mass of from about 1 mg to about 1000 mg, or from about 1 mg to about 700 mg, or from about 1 mg to about 500 mg, or from about 1 mg to about 300 mg, preferably at least about 10 mg, per particle. In one preferred embodiment, the particles preferably have an average mass of from about 1 mg to about 150 mg, or from about 1 mg to about 70 mg, or from about 1 mg to about 50 mg, or from about 1 mg to about 35 mg, or from about 10 mg to about 30 mg, or from about 12 mg to about 25 mg. In an alternative embodiment, the particles preferably have an average mass of from about 10 mg to about 800 mg, or from about 20 mg to about 700 mg, or from about 50 mg to about 700 mg, or from about 70 mg to about 600 mg from about 20 mg to about 600 mg. In one preferred embodiment, the particles have an average mass of about 25 to about 150 mg, preferably from about 40 to about 80 mg. In a further preferred embodiment, the particles have an average mass of from about 150 to about 500 mg, preferably from about 150 to about 300 mg.

The average volume of the particles is preferably in the range of from about 5 to about 500 $mm^3$, from about 5 to about 275 $mm^3$, from about 8 to about 140 $mm^3$, or from about 10 to about 120 $mm^3$, or at least 40 $mm^3$, for instance from about 40 to about 500 $mm^3$, or from about 40 to about 275 $mm^3$, per particle.

The average surface area of the particles is preferably from 10 $mm^2$ to 500 $mm^2$ per particle, preferably from 10 $mm^2$ to 400 $mm^2$, more preferably from 40 to 200 $mm^2$ and especially from 50 to 190 $mm^2$.

The particles preferably have an average particle size of at least 1 mm, preferably at least 2 mm, preferably at least 3 mm, preferably at least 4 mm, and preferably at least 5 mm. The particles preferably have an average particle size no more than 100 mm, preferably no more than 70 mm, preferably no more than 50 mm, preferably no more than 40 mm, preferably no more than 30 mm, preferably no more than 20 mm, preferably no more than 10 mm, and optionally no more than 7 mm. Preferably, the particles have an average particle size of from 1 to 50 mm, preferably from 1 to 20 mm, more preferably from 1 to 10 mm, more preferably from 2 to 10 mm, more preferably from 5 to 10 mm. Particles which offer an especially prolonged effectiveness over a number of treatment cycles are those with an average particle size of at least 5 mm, preferably from 5 to 10 mm. The size is preferably the largest linear dimension (length). For a sphere this equates to the diameter. For non-spheres this corresponds to the longest linear dimension. The size is preferably determined using Vernier callipers. The average particle size is preferably a number average. The determination of the average particle size is preferably performed by measuring the particle size of at least 10, more preferably at least 100 particles and especially at least 1000 particles. The above mentioned particle sizes provide especially good performance (particularly cleaning performance) whilst also permitting the particles to be readily separable from the substrate at the end of the treatment method.

The particles preferably have an average particle density of greater than 1 $g/cm^3$, more preferably greater than 1.1 $g/cm^3$, more preferably greater than 1.2 $g/cm^3$, even more preferably at least 1.25 $g/cm^3$, even more preferably greater than 1.3 $g/cm^3$, and even more preferably greater than 1.4 $g/cm^3$. The particles preferably have an average particle density of no more than 3 $g/cm^3$ and especially no more than 2.5 $g/cm^3$. Preferably, the particles have an average density of from 1.2 to 3 $g/cm^3$. These densities are advantageous for further improving the degree of mechanical action which assists in the treatment process and which can assist in permitting better separation of the particles from the substrate after the treatment.

Unless otherwise stated, reference herein to an "average" is to a mean average, preferably an arithmetic mean average, as is conventional in this art.

The particles of the solid particulate material may be polymeric and/or non-polymeric particles. Suitable non-polymeric particles may be selected from metal, alloy, ceramic and glass particles. Preferably, however, the particles of the solid particulate material are polymeric particles.

Preferably the particles comprise a thermoplastic polymer. A thermoplastic polymer, as used herein, preferably means a material which becomes soft when heated and hard when cooled. This is to be distinguished from thermosets (e.g. rubbers) which will not soften on heating. A more preferred thermoplastic is one which can be used in hot melt compounding and extrusion.

The polymer preferably has a solubility in water of no more than 1 wt %, more preferably no more than 0.1 wt % in water and most preferably the polymer is insoluble in water. Preferably the water is at pH 7 and a temperature of 20° C. whilst the solubility test is being performed. The solubility test is preferably performed over a period of 24 hours. The polymer is preferably not degradable. By the words "not degradable" it is preferably meant that the polymer is stable in water without showing any appreciable tendency to dissolve or hydrolyse. For example, the polymer shows no appreciable tendency to dissolve or hydrolyse over a period of 24 hrs in water at pH 7 and at a temperature of 20° C. Preferably a polymer shows no appreciable tendency to dissolve or hydrolyse if no more than about 1 wt %, preferably no more than about 0.1 wt % and preferably none of the polymer dissolves or hydrolyses, preferably under the conditions defined above. The solubility and degradability characteristics are preferably assessed on a polymeric particle as disclosed herein. The solubility and degradability characteristics are preferably equally applicable to non-polymeric particles.

The polymer may be crystalline or amorphous or a mixture thereof.

The polymer can be linear, branched or partly cross-linked (preferably wherein the polymer is still thermoplastic in nature), more preferably the polymer is linear.

The polymer preferably is or comprises a polyalkylene, a polyamide, a polyester or a polyurethane and copolymers and/or blends thereof, preferably from polyalkylenes, polyamides and polyesters, preferably from polyamides and polyalkylene, and preferably from polyamides.

A preferred polyalkylene is polypropylene.

A preferred polyamide is or comprises an aliphatic or aromatic polyamide, more preferably an aliphatic polyamide. Preferred polyamides are those comprising aliphatic chains, especially $C_4$-$C_{16}$, $C_4$-$C_{12}$ and $C_4$-$C_{10}$ aliphatic chains. Preferred polyamides are or comprise Nylons. Preferred Nylons include Nylon 4,6, Nylon 4,10, Nylon 5, Nylon 5,10, Nylon 6, Nylon 6,6, Nylon 6/6,6, Nylon 6,6/6, 10, Nylon 6,10, Nylon 6,12, Nylon 7, Nylon 9, Nylon 10, Nylon 10,10, Nylon 11, Nylon 12, Nylon 12,12 and copolymers or blends thereof. Of these, Nylon 6, Nylon 6,6 and Nylon 6, 10, and particularly Nylon 6 and Nylon 6,6, and copolymers or blends thereof are preferred. It will be appreciated that these Nylon grades of polyamides are not degradable, wherein the word degradable is preferably as defined above.

Suitable polyesters may be aliphatic or aromatic, and preferably derived from an aromatic dicarboxylic acid and a $C_1$-$C_6$, preferably $C_2$-$C_4$ aliphatic diol. Preferably, the aromatic dicarboxylic acid is selected from terephthalic acid, isophthalic acid, phthalic acid, 1,4-, 2,5-, 2,6- and 2,7-naphthalenedicarboxylic acid, and is preferably terephthalic acid or 2,6-naphthalenedicarboxylic acid, and is most preferably terephthalic acid. The aliphatic diol is preferably ethylene glycol or 1,4-butanediol. Preferred polyesters are selected from polyethylene terephthalate and polybutylene terephthalate. Useful polyesters can have a molecular weight corresponding to an intrinsic viscosity measurement in the range of from about 0.3 to about 1.5 dl/g, as measured by a solution technique such as ASTM D-4603.

Preferably, polymeric particles comprise a filler, preferably an inorganic filler, suitably an inorganic mineral filler in particulate form, such as BaSO4. The filler is preferably present in the particle in an amount of at least 5 wt %, more preferably at least 10 wt %, even more preferably at least 20 wt %, yet more preferably at least 30 wt % and especially at least 40 wt % relative to the total weight of the particle. The filler is typically present in the particle in an amount of no more than 90 wt %, more preferably no more than 85 wt %, even more preferably no more than 80 wt %, yet more preferably no more than 75 wt %, especially no more than 70 wt %, more especially no more than 65 wt % and most especially no more than 60 wt % relative to the total weight of the particle. The weight percentage of filler is preferably established by ashing. Preferred ashing methods include ASTM D2584, D5630 and ISO 3451, and preferably the test method is conducted according to ASTM D5630. For any standards referred to in the present invention, unless specified otherwise, the definitive version of the standard is the most recent version which precedes the priority filing date of this patent application. Preferably, the matrix of said polymer optionally comprising filler(s) and/or other additives extends throughout the whole volume of the particles.

The particles can be spheroidal or substantially spherical, ellipsoidal, cylindrical or cuboid. Particles having shapes which are intermediate between these shapes are also possible. The best results for treatment performance (particularly cleaning performance) and separation performance (separating the substrate from the particles after the treating steps) in combination are typically observed with ellipsoidal particles. Spheroidal particles tend to separate best but may not provide optimum treatment or cleaning performance. Conversely, cylindrical or cuboid particles separate poorly but treat or clean effectively. Spherical and ellipsoidal particles are particularly useful where improved fabric care is important because they are less abrasive. Spheroidal or ellipsoidal particles are particularly useful in the present invention which is designed to operate without a particle pump and wherein the transfer of the particles between the storage means and the interior of the drum is facilitated by rotation of the drum.

The term "spheroidal", as used herein, encompasses spherical and substantially spherical particles. Preferably, the particles are not perfectly spherical. Preferably, the particles have an average aspect ratio of greater than 1, more preferably greater than 1.05, even more preferably greater than 1.07 and especially greater than 1.1. Preferably, the particles have an average aspect ratio of less than 5, preferably less than 3, preferably less than 2, preferably less than 1.7 and preferably less than 1.5. The average is preferably a number average. The average is preferably performed on at least 10, more preferably at least 100 particles and especially at least 1000 particles. The aspect ratio for each particle is preferably given by the ratio of the longest linear dimension divided by the shortest linear dimension. This is preferably measured using Vernier Callipers. Where a good balance between treating performance (particularly cleaning performance) and substrate care is required, it is preferred that the average aspect ratio is within the abovementioned values. When the particles have a very low aspect ratio (e.g. highly spherical particles), the particles may not provide sufficient mechanical action for good treating or cleaning characteristics. When the particles have an aspect ratio which is too high, the removal of the particles from the substrate may become more difficult and/or the abrasion on the substrate may become too high, which may lead to unwanted damage to the substrate, particularly wherein the substrate is a textile.

According to a fourth aspect of the present invention, there is provided a method for treating a substrate, the method comprising agitating the substrate with solid particulate material in the apparatus of the present invention, as described herein. It will be appreciated that the features, preferences and embodiments described herein in respect of the apparatus and solid particulate material are applicable to the fourth aspect of the invention.

Preferably, in the method of the present invention, the solid particulate material is re-used in further treatment procedures.

Preferably the method additionally comprises separating the solid particulate material from the treated substrate. The particles are preferably stored in the storage means for use in the next treatment procedure.

Thus, it will be appreciated that the solid particulate material preferably does not become affixed to or associated with the substrate as a result of the treatment.

Preferably the method comprises rotating the drum for multiple rotations in said first collecting direction and further comprises rotating the drum for multiple rotations in said second collecting direction.

It will be appreciated that during the step of agitating the substrate with solid particulate material, the drum rotates for multiple rotations in said first collecting direction, and may also rotate for multiple rotations in said second collecting direction. Rotation in both directions during the agitating phase may be preferable in order to prevent tangling of the substrates.

It will also be appreciated that during the step of separating the solid particulate material from the treated substrate, the drum can rotate for multiple rotations in said first collecting direction and/or said second collecting direction. Rotation in both directions during the separating phase may be advantageous in order to facilitate better separation of the solid particulate material from the treated substrate. The separating phase may comprise a greater number of rotations in one of the first or second collecting direction compared to the other of the first or second collecting direction.

The method preferably comprises agitating the substrate with solid particulate material and a liquid medium. Preferably, the method comprises agitating the substrate with said solid particulate material and a treatment formulation. Preferably, the method comprises agitating the substrate with said solid particulate material, a liquid medium and one or more treatment formulation(s).

The method may comprise the additional step of rinsing the treated substrate. Rinsing is preferably performed by adding a rinsing liquid medium, optionally comprising one or more post-treatment additives, to the treated substrate. The rinsing liquid medium is preferably an aqueous medium as defined herein.

Thus, preferably, the method is a method for treating multiple batches, wherein a batch comprises at least one substrate, the method comprising agitating a first batch with solid particulate material, wherein said method further comprises the steps of:

(a) collecting said solid particulate material in the storage means;

(b) agitating a second batch comprising at least one substrate with solid particulate material collected from step (a); and (c) optionally repeating steps (a) and (b) for subsequent batch(es) comprising at least one substrate.

The treatment procedure of an individual batch typically comprises the steps of agitating the batch with said solid particulate material in a treatment apparatus for a treatment cycle. A treatment cycle typically comprises one or more discrete treatment step(s), optionally one or more rinsing step(s), optionally one or more step(s) of separating the solid particulate material from the treated batch (a "separation step"), optionally one or more extraction step(s) of removing liquid medium from the treated batch, optionally one or more drying step(s), and optionally the step of removing the treated batch from the apparatus.

In the method of the present invention, steps (a) and (b) may be repeated at least 1 time, preferably at least 2 times, preferably at least 3 times, preferably at least 5 times, preferably at least 10 times, preferably at least 20 times, preferably at least 50 times, preferably at least 100 times, preferably at least 200 times, preferably at least 300 times, preferably at least 400 at least or preferably at least 500 times. Thus, the same solid particulate material is preferably re-used in repeated methods of the present invention, i.e. the solid particulate material is re-used preferably at least 1 time, preferably at least 2 times, preferably at least 3 times, preferably at least 5 times, preferably at least 10 times, preferably at least 20 times, preferably at least 50 times, preferably at least 100 times, preferably at least 200 times, preferably at least 300 times, preferably at least 400 at least or preferably at least 500 times.

The substrate may be or comprise a textile and/or an animal skin substrate. In a preferred embodiment, the substrate is or comprises a textile. The textile may be in the form of an item of clothing such as a coat, jacket, trousers, shirt, skirt, dress, jumper, underwear, hat, scarf, overalls, shorts, swim wear, socks and suits. The textile may also be in the form of a bag, belt, curtains, rug, blanket, sheet or a furniture covering. The textile can also be in the form of a panel, sheet or roll of material which is later used to prepare the finished item or items. The textile can be or comprise a synthetic fibre, a natural fibre or a combination thereof. The textile can comprise a natural fibre which has undergone one or more chemical modifications. Examples of natural fibres include hair (e.g. wool), silk and cotton. Examples of synthetic textile fibres include Nylon (e.g. Nylon 6,6), acrylic, polyester and blends thereof. As used herein, the term "animal skin substrate" includes, hides, pelts, leather and fleeces. Typically, the animal skin substrate is a hide or a pelt. The hide or pelt may be a processed or unprocessed animal skin substrate. Suitable animal skin substrates include cattle, pigs, sheep, goats and buffalo. Preferably the animal skin substrate is a bovine skin substrate. Skin substrates of livestock and especially cattle are preferred. It will be appreciated that, in the context of the present invention, the term "animal skin" excludes human skin.

The treating of a substrate which is or comprises a textile according to the present invention may be a cleaning process or any other treatment process such as coloration (preferably dyeing), ageing or abrading (for instance stone-washing), bleaching or other finishing process. Stonewashing is a known method for providing textiles having "worn in" or "stonewashed" characteristics such as a faded appearance, a softer feel and a greater degree of flexibility. Stonewashing is frequently practiced with denim. Preferably the treating of a substrate which is or comprises a textile is a cleaning process. The cleaning process may be a domestic or industrial cleaning process.

As used herein, the term "treating" in relation to treating an animal skin substrate is preferably a tannery process, including colouring and tanning and associated tannery processes, preferably selected from curing, beamhouse treatments, pre-tanning, tanning, re-tanning, fat liquoring, enzyme treatment, tawing, crusting, dyeing and dye fixing, preferably wherein said beamhouse treatments are selected from soaking, liming, deliming, reliming, unhairing, fleshing, bating, degreasing, scudding, pickling and depickling. Preferably, said treating of an animal skin substrate is a process used in the production of leather. Preferably, said treating acts to transfer a tanning agent (including a colourant or other agent used in a tannery process) onto or into the animal skin substrate.

The treatment formulation referred to herein may comprise one or more treatment agent(s) which are suitable to effect the desired treating of the substrate.

Thus, a method according to the present invention which is a cleaning process suitably comprises agitating the substrate with said solid particulate material, a liquid medium and one or more treatment formulation(s) wherein said treatment formulation is preferably a detergent composition comprising one or more of the following components: surfactants, dye transfer inhibitors, builders, enzymes, metal chelating agents, biocides, solvents, stabilizers, acids, bases and buffers.

Similarly, the treatment formulation of a coloration process is preferably a composition comprising one or more dyes, pigments, optical brighteners and mixtures thereof.

The treatment formulation of a stone-washing process may comprise an appropriate stone-washing agent, as known in the art, for instance an enzymatic treatment agent such as a cellulase.

The treatment formulation of a tannery process suitably comprises one or more agent(s) selected from tanning agents, re-tanning agents and tannery process agents. The treatment formulation may comprise one or more colourant (s). The tanning or re-tanning agent is preferably selected from synthetic tanning agents, vegetable tanning or vegetable re-tanning agents and mineral tanning agents such as chromium (III) salts or salts and complexes containing iron, zirconium, aluminium and titanium. Suitable synthetic tanning agents include amino resins, polyacrylates, fluoro and/or silicone polymers and formaldehyde condensation polymers based on phenol, urea, melamine, naphthalene, sulphone, cresol, bisphenol A, naphthol and/or biphenyl ether. Vegetable tanning agents comprise tannins which are typically polyphenols. Vegetable tanning agents can be obtained from plant leaves, roots and especially tree barks. Examples of vegetable tanning agents include the extracts of the tree barks from chestnut, oak, redoul, tanoak, hemlock, quebracho, mangrove, wattle acacia; and myrobalan. Suitable mineral tanning agents comprise chromium compounds, especially chromium salts and complexes, typically in a chromium (III) oxidation state, such as chromium (III) sulphate. Other tanning agents include aldehydes (glyoxal, glutaraldehyde and formaldehyde), phosphonium salts, metal compounds other than chromium (e.g. iron, titanium, zirconium and aluminium compounds). Preferably, the tanning agents are substantially free from chromium-containing compounds.

One or more substrates can be simultaneously treated by the method of the invention. The exact number of substrates will depend on the size of the substrates and the capacity of the apparatus utilized.

The total weight of dry substrates treated at the same time (i.e. in a single batch or washload) may be up to 50,000 kg. For textile substrates, the total weight is typically from 1 to 500 kg, more typically 1 to 300 kg, more typically 1 to 200 kg, more typically from 1 to 100 kg, even more typically from 2 to 50 kg and especially from 2 to 30 kg. For animal substrates, the total weight is normally at least about 50 kg, and can be up to about 50,000 kg, typically from about 500 to about 30,000 kg, from about 1000 kg to about 25,000 kg, from about 2000 to about 20,000 kg, or from about 2500 to about 10,000 kg.

Preferably the liquid medium is an aqueous medium, i.e. the liquid medium is or comprises water. In order of increasing preference, the liquid medium comprises at least 50 wt %, at least 60 wt %, at least 70 wt %, at least 80 wt %, at least 90 wt %, at least 95 wt % and at least 98 wt % of water. The liquid medium may optionally comprise one or more organic liquids including for example alcohols, glycols, glycol ethers, amides and esters. Preferably, the sum total of all organic liquids present in the liquid medium is no more than 10 wt %, more preferably no more than 5 wt %, even more preferably no more than 2 wt %, especially no more than 1% and most especially the liquid medium is substantially free from organic liquids.

The liquid medium preferably has a pH of from 3 to 13. The pH or the treatment liquor can differ at different times, points or stages in the treatment method according to the invention. It can be desirable to treat (particularly to clean) a substrate under alkaline pH conditions, although while higher pH offers improved performance (particularly cleaning performance) it can be less kind to some substrates. Thus, it can be desirable that the liquid medium has a pH of from 7 to 13, more preferably from 7 to 12, even more preferably from 8 to 12 and especially from 9 to 12. In a further preferred embodiment, the pH is from 4 to 12, preferably 5 to 10, especially 6 to 9, and most especially 7 to 9, particularly in order to improve fabric care. It may also be desirable that the treating of a substrate, or one or more specific stage(s) of a treatment process, is conducted under acid pH conditions. For instance, certain steps in the treatment of animal skin substrates are advantageously conducted at a pH which is typically less than 6.5, even more typically less than 6 and most typically less than 5.5, and typically no less than 1, more typically no less than 2 and most typically no less than 3. Certain fabric or garment finishing treatment methods, for instance stone-washing, may also utilise one or more acidic stage(s). An acid and/or base may be added in order to obtain the abovementioned pH values. Preferably, the abovementioned pH is maintained for at least a part of the duration, and in some preferred embodiments for all of the duration, of the agitation. In order to prevent the pH of the liquid medium from drifting during the treatment, a buffer may be used.

Preferably, the weight ratio of the liquid medium to the dry substrate is no more than 20:1, more preferably no more than 10:1, especially no more than 5:1, more especially no more than 4.5:1 and even more especially no more than 4:1 and most especially no more than 3:1. Preferably, the weight ratio of liquid medium to the dry substrate is at least 0.1:1, more preferably at least 0.5:1 and especially at least 1:1. In the present invention, it is possible to use surprisingly small amounts of liquid medium whilst still achieving good treatment performance (particularly cleaning performance), which has environmental benefits in terms of water usage, waste water treatment and the energy required to heat or cool the water to the desired temperature.

Preferably, the ratio of particles to dry substrate is at least 0.1, especially at least 0.5 and more especially at least 1:1 w/w. Preferably, the ratio of particles to dry substrate is no more than 30:1, more preferably no more than 20:1, especially no more than 15:1 and more especially no more than 10:1 w/w. Preferably, the ratio of the particles to dry substrate is from 0.1:1 to 30:1, more preferably from 0.5:1 to 20:1, especially from 1:1 to 15:1 w/w and more especially from 1:1 to 10:1w/w.

The treatment method agitates the substrate in the presence of the solid particulate material. The agitation may be in the form of shaking, stirring, jetting and tumbling. Of these, tumbling is especially preferred. Preferably, the substrate and solid particulate material are introduced into the drum which is rotated so as to cause tumbling. The rotation can be such as to provide a centripetal force of from 0.05 to 1 G and especially from 0.05 to 0.7 G. The centripetal force is preferably as calculated at the interior walls of the drum furthest away from the axis of rotation.

The solid particulate material is able to contact the substrate, suitably mixing with the substrate during the agitation.

The agitation may be continuous or intermittent. Preferably, the method is performed for a period of from 1 minute to 10 hours, more preferably from 5 minutes to 3 hours and even more preferably from 10 minutes to 2 hours.

The treatment method is preferably performed at a temperature of from greater than 0° ° C. to about 95° C., preferably from 5 to 95° C., preferably at least 10° C., preferably at least 15° C., preferably no more than 90° C., preferably no more than 70° C., and advantageously no more 50° C., no more than 40° C. or no more than 30° C. Such milder temperatures allow the particles to provide the aforementioned benefits over larger numbers of treatment cycles. Preferably, when several batches or washloads are treated or cleaned, every treating or cleaning cycle is performed at no more than a temperature of 95° C., more preferably at no more than 90° C., even more preferably at no more than 80° C., especially at no more than 70° C., more especially at no more than 60° C. and most especially at no more than 50° C., and from greater than 0° C., preferably at least 5° ° C., preferably at least 10° C., preferably at least 15° C., preferably from greater than 0 to 50° C., greater than 0 to 40° ° C., or greater than 0 to 30° C., and advantageously from 15 to 50° C., 15 to 40° C. or 15 to 30° C. These lower temperatures again allow the particles to provide the benefits for a larger number of treatment or wash cycles.

It will be appreciated that the duration and temperature conditions described hereinabove are associated with the treating of an individual batch comprising at least one of said substrate(s).

Agitation of the substrates with the solid particulate material suitably takes place in said one or more discrete treating step(s) of the aforementioned treatment cycle. Thus, the duration and temperature conditions described hereinabove are preferably associated with the step of agitating said substrate(s) with solid particulate material, i.e. said one or more discrete treating step(s) of the aforementioned treatment cycle.

Preferably, the method is a method for cleaning a substrate, preferably a laundry cleaning method, preferably a method for cleaning a substrate which is or comprises a textile. Thus, preferably, a batch is a washload. Preferably the washload comprises at least one soiled substrate, preferably wherein the soiled substrate is or comprises a soiled textile. The soil may be in the form of, for example, dust, dirt, foodstuffs, beverages, animal products such as sweat, blood, urine, faeces, plant materials such as grass, and inks and paints. The cleaning procedure of an individual washload typically comprises the steps of agitating the washload with said solid particulate material in a cleaning apparatus for a cleaning cycle. A cleaning cycle typically comprises one or more discrete cleaning step(s) and optionally one or more post-cleaning treatment step(s), optionally one or more rinsing step(s), optionally one or more step(s) of separating the cleaning particles from the cleaned washload, optionally one or more extraction step(s) of removing liquid medium from the cleaned washload, optionally one or more drying step(s), and optionally the step of removing the cleaned washload from the cleaning apparatus.

Where the method is a cleaning method, the substrate is preferably agitated with said solid particulate material, a liquid medium, and preferably also a detergent composition. The detergent composition may comprise any one or more of the following components: surfactants, dye transfer inhibitors, builders, enzymes, metal chelating agents, biocides, solvents, stabilizers, acids, bases and buffers. In particular, the detergent composition may comprise one or more enzyme(s).

Where the method is a cleaning method, optional post-cleaning additives which may be present in a rinsing liquid medium include optical brightening agents, fragrances and fabric softeners.

Kit for Conversion of Conventional Apparatus and Method of Retrofitting

According to a fifth aspect of the present invention, there is provided a kit for converting an apparatus which is not suitable for use in the treatment of substrates using a solid particulate material into an apparatus according to the present invention and defined hereinabove which is suitable for use in the treatment of substrates using a solid particulate material, wherein the apparatus comprises a housing having mounted therein a rotatably mounted drum having an inner surface and an end wall and which further comprises access means for introducing said substrates into said drum, and wherein said kit comprises:

(a) solid particulate material;

(b) storage means for storage of said solid particulate material; and (c) at least one first elongate protrusion as described herein having a first collecting flow path and a second collecting flow path, or at least one first elongate protrusion as described herein having a first collecting flow path in combination with at least one second elongate protrusion as described herein having a second collecting flow path, wherein said first collecting flow path facilitates flow of said solid particulate material from the interior of said drum to said storage means when said drum rotates in a first collecting direction, wherein said second collecting flow path facilitates flow of said solid particulate material from the interior of said drum to said storage means when said drum rotates in a second collecting direction, wherein said second collecting direction is in the opposite rotational direction to said first collecting direction, and wherein said first collecting flow path and said second collecting flow path are different flow paths, wherein said kit is adapted to allow affixing of said storage means and said first elongate protrusion(s) and, where present, said second elongate protrusion(s) to one or more interior surface(s) of the drum.

According to a sixth aspect of the present invention, there is provided a kit for converting an apparatus which is not suitable for use in the treatment of substrates using a solid particulate material into an apparatus according to the present invention and defined hereinabove which is suitable for use in the treatment of substrates using a solid particulate material, wherein the apparatus comprises a housing having mounted therein a rotatably mounted drum having an inner surface and an end wall and which further comprises access means for introducing said substrates into said drum, and wherein said kit comprises:

(a) solid particulate material;

(b) storage means for storage of said solid particulate material; and (c) at least one lifter as described herein wherein said first collecting flow path facilitates flow of said solid particulate material from the interior of said drum to said storage means when said drum rotates in a first collecting direction, wherein said second collecting flow path facilitates flow of said solid particulate material from the interior of said drum to said storage means when said drum rotates in a second collecting direction, wherein said second collecting direction is in the opposite rotational direction to said first collecting direction, and wherein said first collecting flow path and said second collecting flow path are different flow paths.

According to a seventh aspect of the present invention, there is provided a method of constructing an apparatus according to the present invention and as defined hereinabove which is suitable for use in the treatment of substrates using a solid particulate material, the method comprising retrofitting a starting apparatus which is not suitable for use in the treatment of substrates using a solid particulate material and which comprises a housing having mounted therein a rotatably mounted drum having an inner surface and an end wall and which further comprises access means for introducing said substrates into said drum, wherein said retrofitting comprises the steps of:

(i) providing solid particulate material, providing one or more storage means for storage of solid particulate material, and providing at least one elongate protrusion (s);

(ii) affixing said storage means to one or more interior surface(s) of the drum; and (iii) affixing to an interior surface of the drum at least one first elongate protrusion as described herein having a first collecting flow path and a second collecting flow path, or at least one first elongate protrusion as described herein having a first collecting flow path and at least one second elongate protrusion as described herein having a second collecting flow path or, in particular, at least one lifter as described herein, wherein said first collecting flow path facilitates flow of said solid particulate material from the interior of said drum to said storage means when said drum rotates in a first collecting direction, wherein said second collecting flow path facilitates flow of said solid particulate material from the interior of said drum to said storage means when said drum rotates in a second collecting direction, wherein said second collecting direction is in the opposite rotational direction to said first collecting direction, and wherein said first collecting flow path and said second collecting flow path are different flow paths.

It will be appreciated that the features, preferences and embodiments described hereinabove for the first to fourth aspects are applicable also to the fifth to seventh aspects.

FIGURES

The invention is further illustrated with reference to the following figures.

Figure 1:
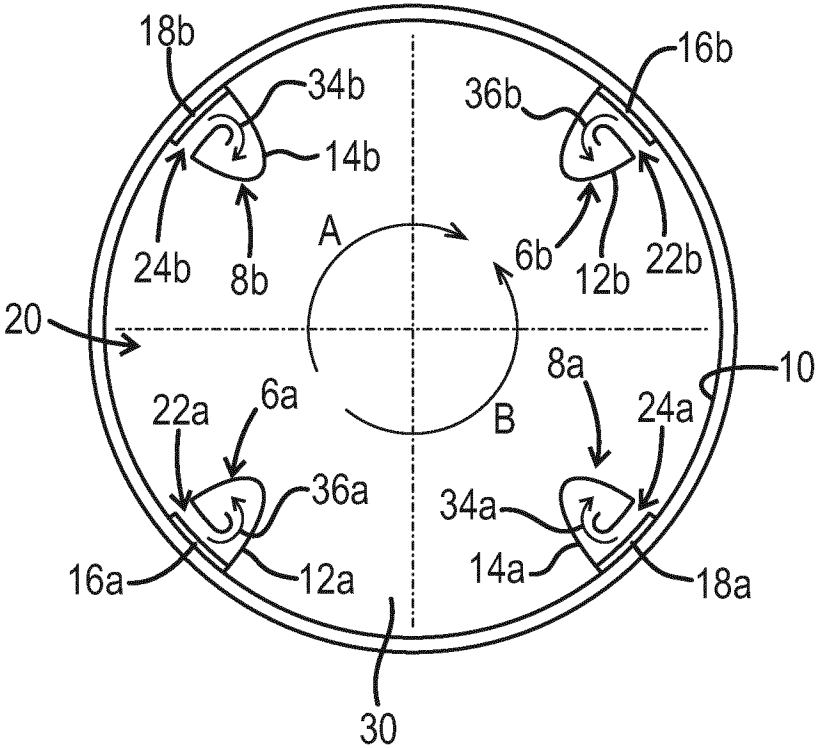
FIG. 1 illustrates a schematic cross-section of a drum of the apparatus of the present invention.

FIG. 1 illustrates a schematic cross-section of a drum (2) of the apparatus of the present invention. The cylindrical drum (2) has an inner surface (10). Two first elongate protrusions (12*a*, 12*b*) having base plates (16*a*, 16*b*) are attached via fixings (not shown) in the base plates (16*a*, 16*b*) to the inner surface (10) of the drum (2). Each of the two first elongate protrusions (12*a*, 12*b*) has a plurality of first collecting apertures (22*a*, 22*b*) in a first side (6*a*, 6*b*). As the drum rotates clockwise (indicated by arrow A), solid particulate material (now shown) in the interior (20) of the drum (2) can enter a first collecting flow path (represented by arrow 36*a*, 36*b*) inside the first elongate protrusions (12*a*, 12*b*) via the first collecting apertures (22*a*, 22*b*). The solid particulate material follows the first collecting flow path (arrow 36*a*, 36*b*) towards storage means (30) in the end wall of the drum (2) as the drum rotates in the direction shown by arrow A.

Two second elongate protrusions (14*a*, 14*b*) having base plates (18*a*, 18*b*) are attached via fixings (not shown) in the base plates (18*a*, 18*b*) to the inner surface (10) of the drum (2). Each of the two second elongate protrusions (14*a*, 14*b*) has a plurality of second collecting apertures (24*a*, 24*b*) in a first side (8*a*, 8*b*). As the drum rotates counter-clockwise (indicated by arrow B), solid particulate material (not shown) in the interior (20) of the drum (2) can enter a second collecting flow path (represented by arrow 34*a*, 34*b*) inside the second elongate protrusions (14*a*, 14*b*) via the second collecting apertures (24*a*, 24*b*). The solid particulate material follows the second collecting flow path (arrow 34*a*, 34*b*) towards storage means (30) in the end wall of the drum (2) as the drum rotates in the direction shown by arrow B.

FIG. 2 illustrates a schematic cross-section of a drum (2) of the apparatus of the present invention. The cylindrical drum (2) has an inner surface (10). Four first elongate protrusions (100) having base plates (110) are attached via fixings (not shown) in the base plate (110) to the inner surface (10) of the drum (2). Each of the first elongate protrusions (100) has a plurality of first collecting apertures (122) in a first side (106). As the drum rotates clockwise (indicated by arrow A), solid particulate material (not shown) in the interior (20) of the drum (2) can enter a first collecting flow path inside a first lengthwise portion (134) of the first elongate protrusions (100) via the first collecting apertures (122). The solid particulate material follows the first collecting flow path towards storage means (30) in the end wall of the drum (2) as the drum rotates in the direction shown by arrow A. Each of the first elongate protrusions (100) also has a plurality of second collecting apertures (124) in a second side (108). As the drum rotates counter-clockwise (indicated by arrow B), solid particulate material (not shown) in the interior (20) of the drum (2) can enter a second collecting flow path inside a second lengthwise portion (136) of the first elongate protrusions (100) via the second collecting apertures (124). The solid particulate material follows the second collecting flow path towards storage means (30) in the end wall of the drum (2) as the drum rotates in the direction shown by arrow B. Each of the first elongate protrusions (100) has a barrier (102) that extends from the base plate (110) towards, but does not reach, a top portion (140) of the first elongate protrusion. The barrier (102) at least partially separate the first lengthwise portion (134) from the second lengthwise portion (136). Solid particulate material in said first flow path may transfer from the first lengthwise portion (134) across the barrier (102) to the second lengthwise portion (136) when said drum changes direction and rotates in the direction indicated by arrow B, thereby continuing to be urged towards the storage means. Solid particulate material in said second flow path may transfer from the second lengthwise portion (136) across the barrier (102) to the first lengthwise portion (134) when said drum changes direction and rotates in the direction indicated by arrow A, thereby continuing to be urged towards the storage means.

Figure 3:
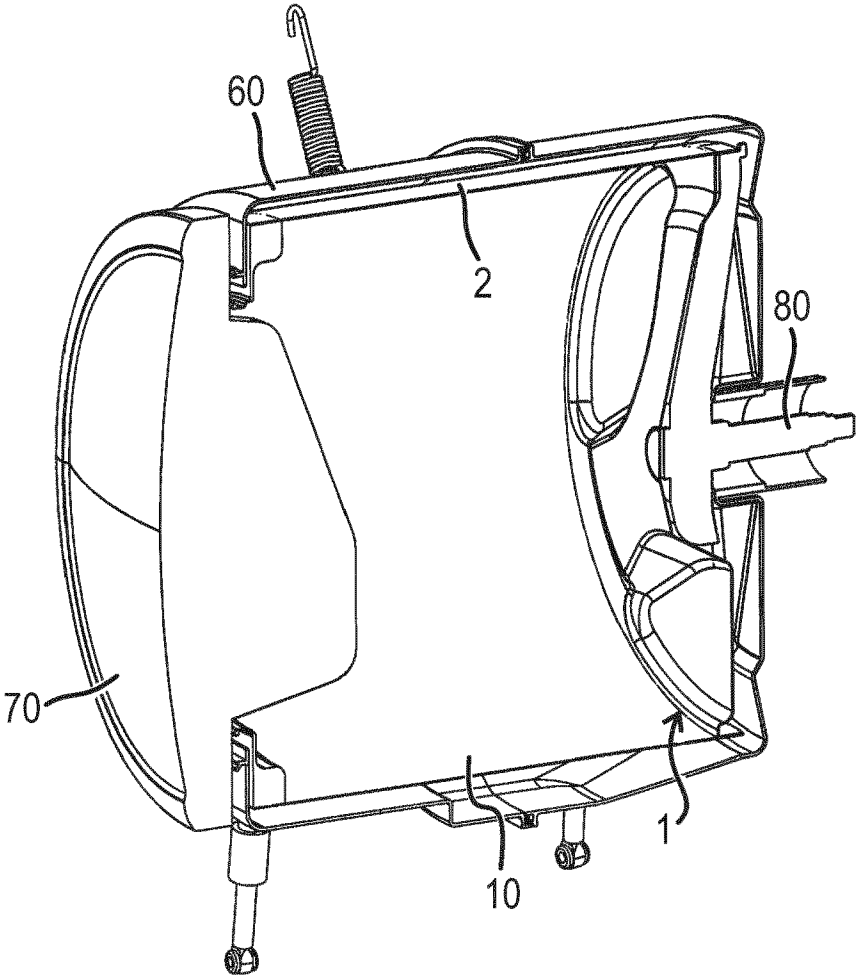
FIG. 3 shows certain elements of a rotatable drum.

FIG. 3 shows certain elements of a rotatable drum (2) having an end wall (1) and a cylindrical inner surface (10), and located in a housing (60), wherein the interior of the drum is accessed by access means (70) and wherein the drum is connected to drive shaft (80) from a drive means (not shown) to effect rotation of the drum.

Figure 4:
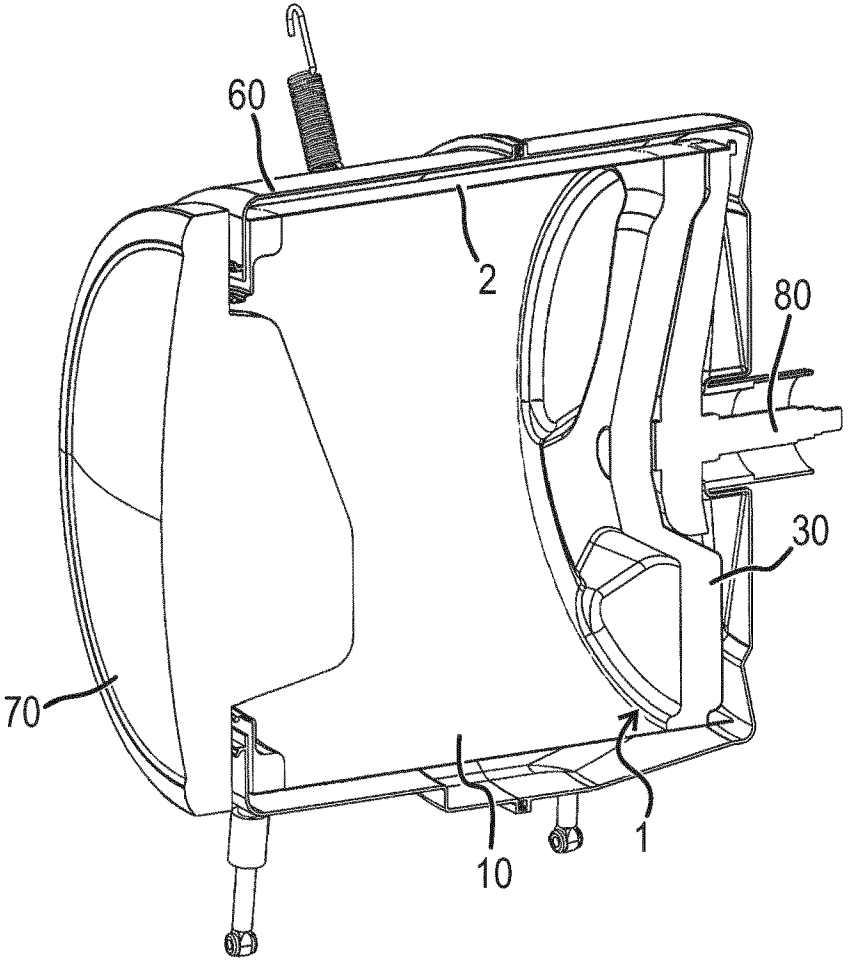
FIG. 4 illustrates the arrangement of FIG. 3 wherein a storage means is disposed in, or retrofitted onto, the existing end wall of the drum.

FIG. 4 shows the arrangement of FIG. 3 wherein a storage means (30) is disposed in, or retrofitted onto, the existing end wall (1) of the drum.

Figure 5:
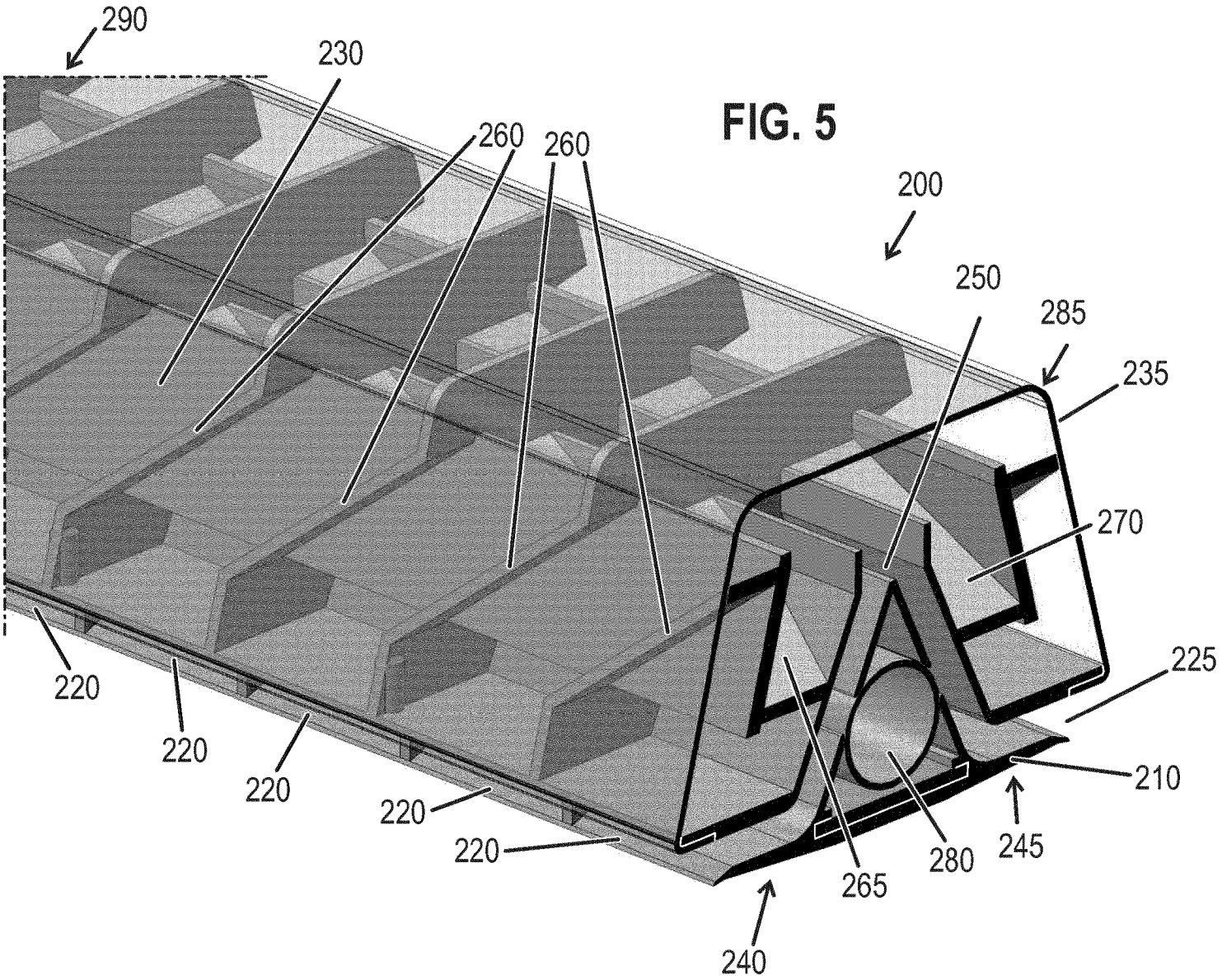
FIG. 5 shows a partial view of a first elongate protrusion, or a lifter, of the present invention.

FIG. 5 shows a partial view of a first elongate protrusion of the first embodiment, or a lifter (200), of the present invention. The lifter comprises a base portion (210) for affixing the lifter to the interior surface of a drum (not shown). The lifter (200) has a first end (290) proximal to the end wall of a drum (not shown) and a second end (285) distal from the end wall of the drum (not shown). The lifter has a plurality of first collecting apertures (220) in a first side (230) of the lifter. Solid particulate material (not shown) that enters via the first collecting apertures (220) follows a first collecting path within the lifter (200). The lifter has a plurality of second collecting apertures (225) in a second side of the lifter (235). Solid particulate material (not shown) that enters via the second collecting apertures (225) follows a second collecting path within the lifter (200). The lifter comprises a first lengthwise portion (240) and a second lengthwise portion (245) partially separated by a barrier (250). The first lengthwise portion (240) comprises a first series of deflectors (260), which are substantially parallel to each other. The first lengthwise portion (240) also comprises a second series of deflectors (265), which are substantially parallel to each other but which are not parallel to deflectors in said first series (260). The second lengthwise portion (245) comprises a first series of deflectors (270), which are substantially parallel to each other. The second lengthwise portion (245) also comprises a second series of deflectors (not shown), which are substantially parallel to each other but which are not parallel to deflectors in said first series (270). The lifter has an aperture (280) in which a tie bar can be located.

Solid particulate material (not shown) that enters via the first collecting apertures (220) is urged towards the first end of the lifter (290) by deflectors (260) and (265) as the drum rotates in the first collecting direction. In this way, the first flow path generally follows an Archimedean screw-like path along the first lengthwise portion (240) of the lifter (200) when the drum is rotating in the first collecting direction. When the direction of rotation of the drum changes to the second collecting direction, solid particulate material in the first collecting flow path can transfer across the barrier (250) into the second lengthwise portion (245), where it is urged towards the first end of the lifter (290) by deflectors (270) and the second series of deflectors in the second lengthwise portion that are not shown.

Solid particulate material (not shown) that enters via the second collecting apertures (225) is urged towards the first end of the lifter (290) by deflectors (270) and the second series of deflectors (not shown) in the second lengthwise portion (245) as the drum rotates in the second collecting direction. In this way, the second flow path generally follows an Archimedean screw-like path along the second lengthwise portion (245) of the lifter (200) when the drum is rotating in the second collecting direction. When the direction of rotation of the drum changes to the first collecting direction, solid particulate material in the second collecting flow path can transfer across the barrier (250) into the first lengthwise portion (240), where it is urged towards the first end of the lifter (290) by deflectors (260) and (265).

Figure 6:
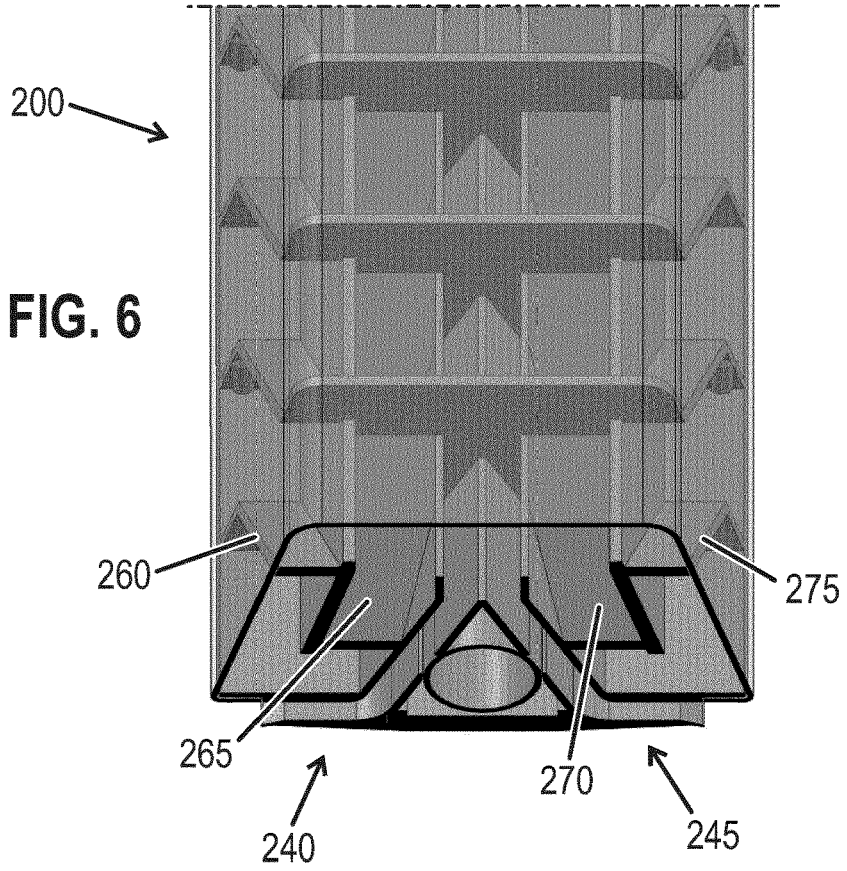
FIG. 6 is an alternative view of a portion of the lifter of FIG. 5.

FIG. 6 is an alternative view of a portion of the lifter of FIG. 5, showing the first series of deflectors (260) and the second series of deflectors (265) in the first lengthwise portion (240) plus the first series of deflectors (270) and the second series of deflectors (275) in the second lengthwise portion (245).

Figure 7:
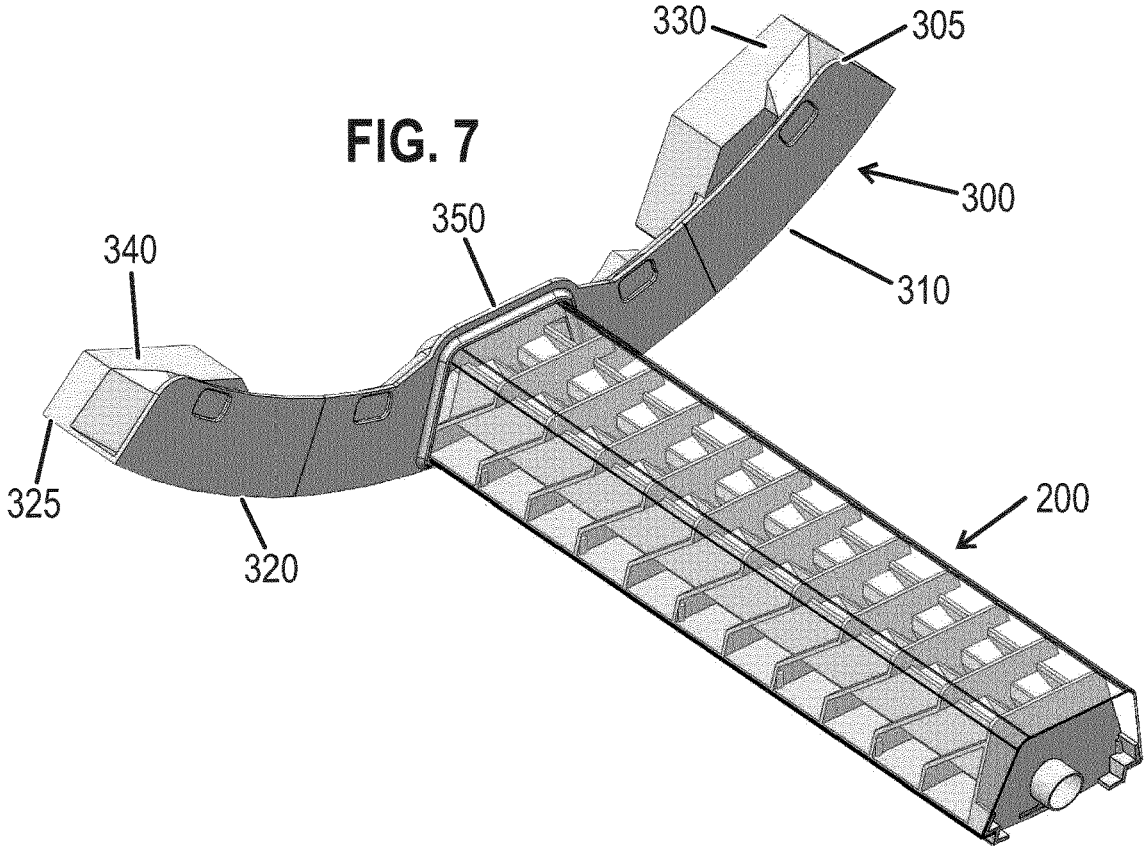
FIG. 7 shows the lifter of FIG. 5 connected to a delivery duct.

FIG. 7 shows the lifter (200) of FIG. 5 connected to a delivery duct (300) for assembly into the drum (not shown) of an apparatus of the invention. The delivery duct (300) is shaped to correspond with the circumference of the end wall of the drum. The delivery duct has a central portion (350) comprising a first entry aperture (not shown) for solid particulate material that has followed a first flow path or a second flow path through the lifter (200). The delivery duct has a first arm (310) extending from the central portion (350) in a first direction and a second arm (320) extending from the central portion (350) in a second direction. The first arm (310) has a first exit aperture (not shown) at a first end (305) of the first arm (310). The second arm (320) has a second exit aperture (not shown) at a second end (325) of the second arm (320). The first arm (310) has a first arrangement of baffles (330) configured to regulate the flow of solid particulate material that nears the first exit aperture. The second arm (320) has a second arrangement of baffles (340) configured to regulate the flow of solid particulate material that nears the second exit aperture.

Figure 8:
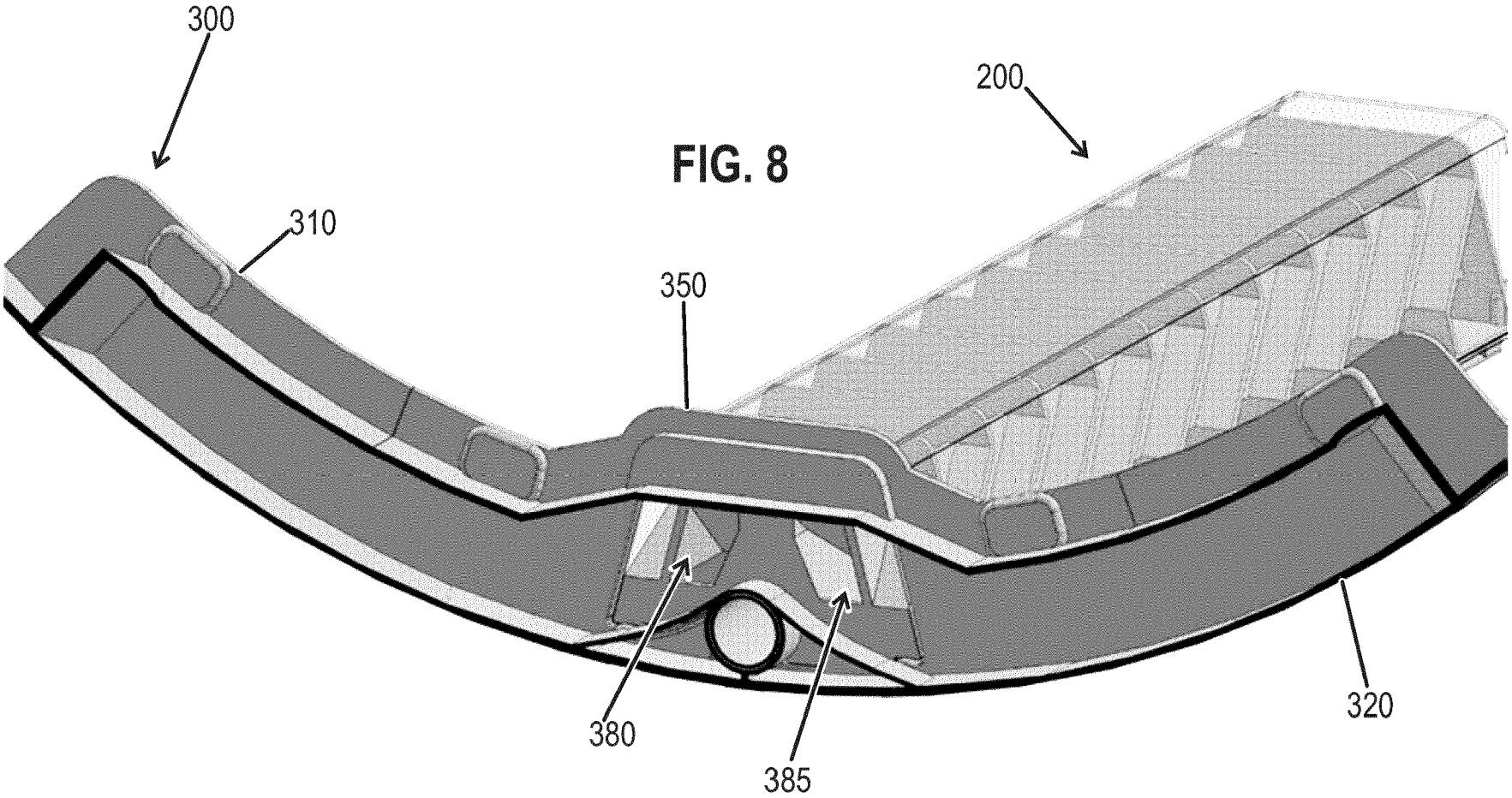
FIG. 8 is a reverse view of the lifter and delivery duct of FIG. 7.

FIG. 8 is a reverse view of the lifter (200) and delivery duct (300) of FIG. 7, showing a first entry aperture (385) from the lifter (200) into the central portion (350) of the delivery duct (300) and a second entry aperture (380) from the lifter (200) into the central portion (350) of the delivery duct.

Figure 9:
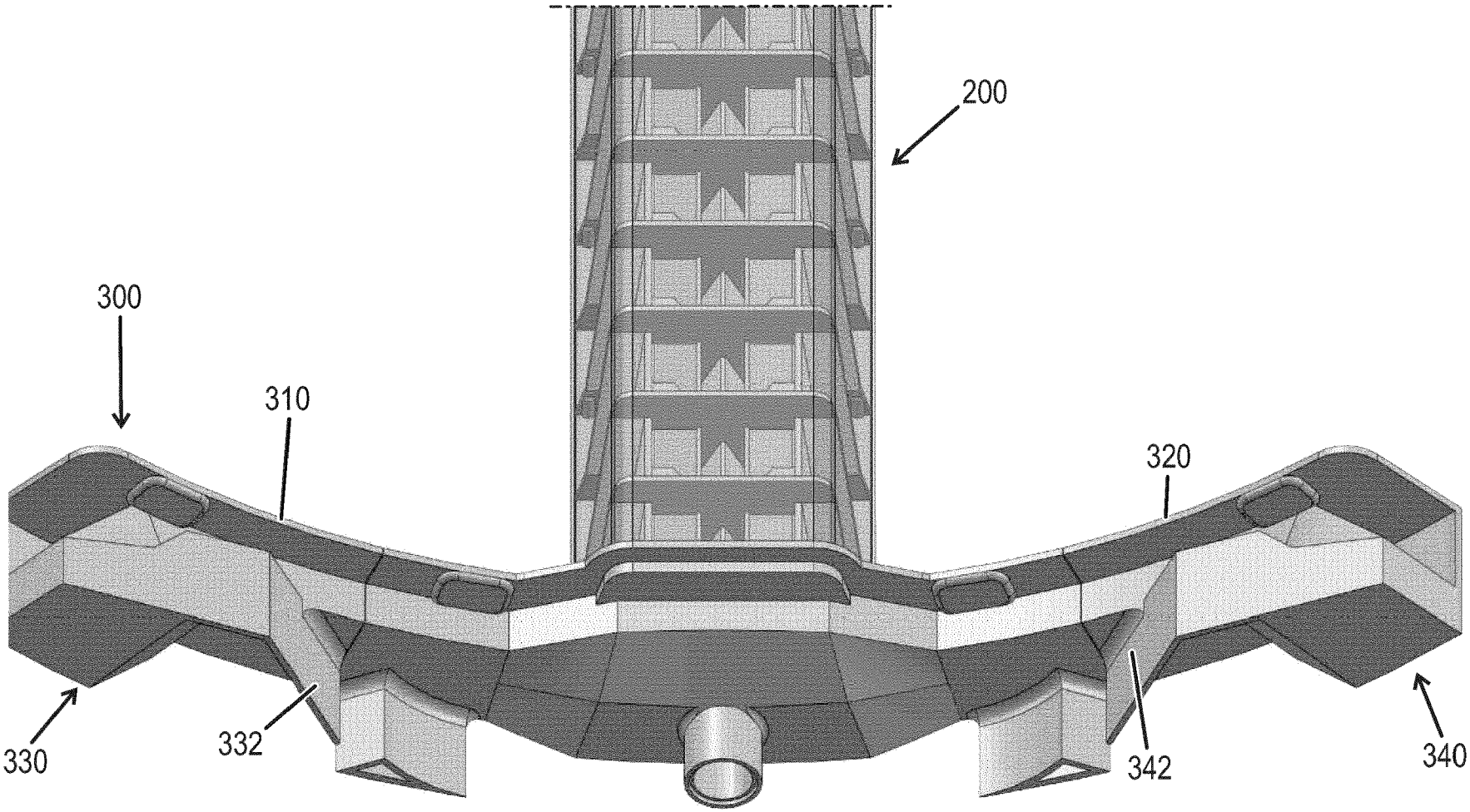
FIG. 9 shows a further view of the lifter and delivery duct of FIGS. 7 and 8.
Figure 10:
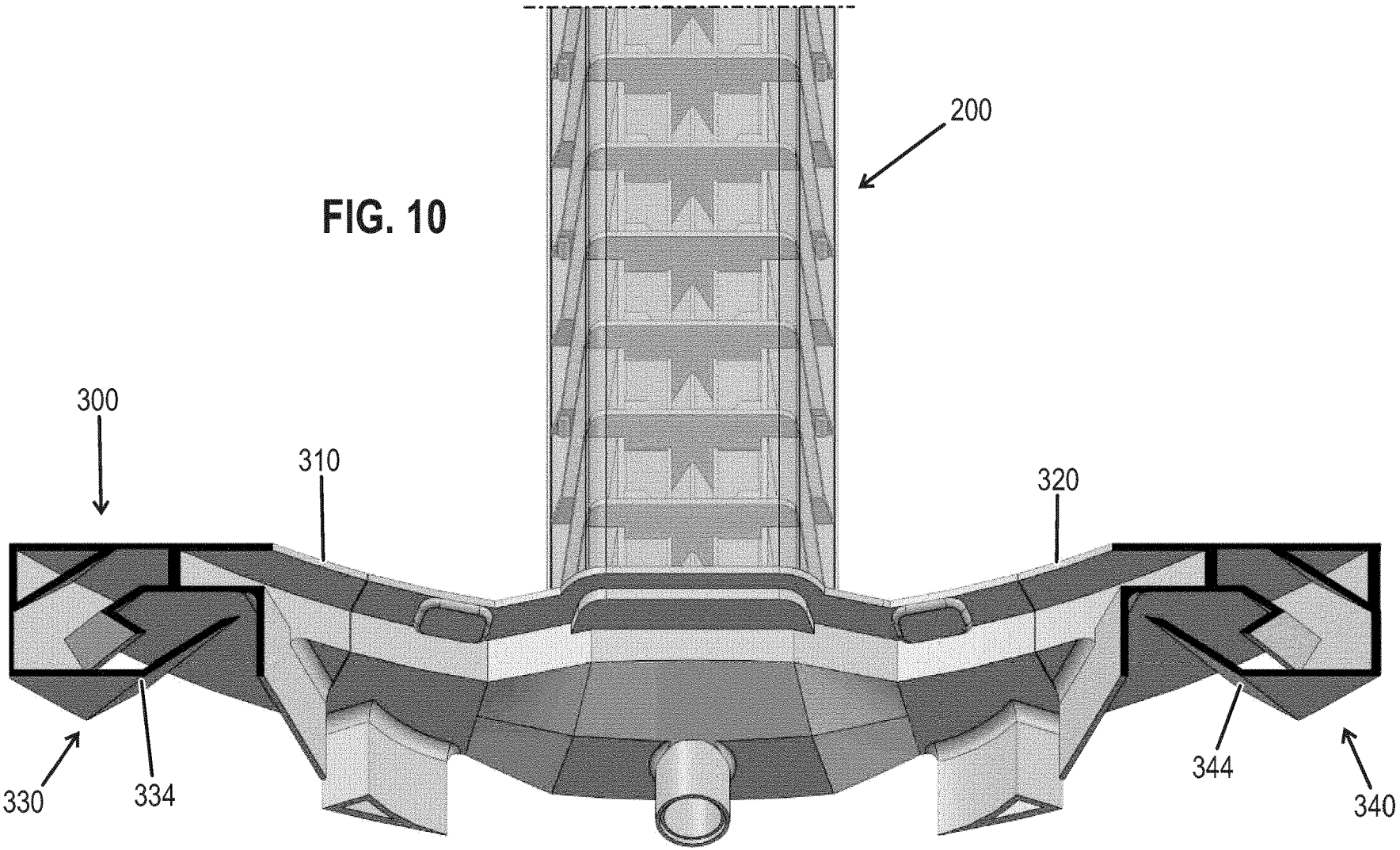
FIG. 10 shows a further view of the lifter and delivery duct of FIGS. 7 and 8.

FIGS. 9 and 10 show a further view of the lifter (200) and delivery duct (300) of FIGS. 7 and 8 and illustrate the first arrangement of baffles (330) and the second arrangement of baffles (340). The first arrangement of baffles (330) comprises a first baffle (332) and a second baffle (334). The second arrangement of baffles (340) comprises a first baffle (342) and a second baffle (344). The first baffles (332, 342) and the second baffles (334, 344) are configured to discourage, preferably to prevent, solid particulate material that has passed said first baffle when travelling through the delivery duct towards the storage means from returning back towards the lifter (200). The first baffles (332, 342) and second baffles (334, 344) are also configured to urge towards the storage means (not shown) the solid particulate material (not shown) that has passed said first baffles (332, 342) as the drum rotates.

Figure 11:
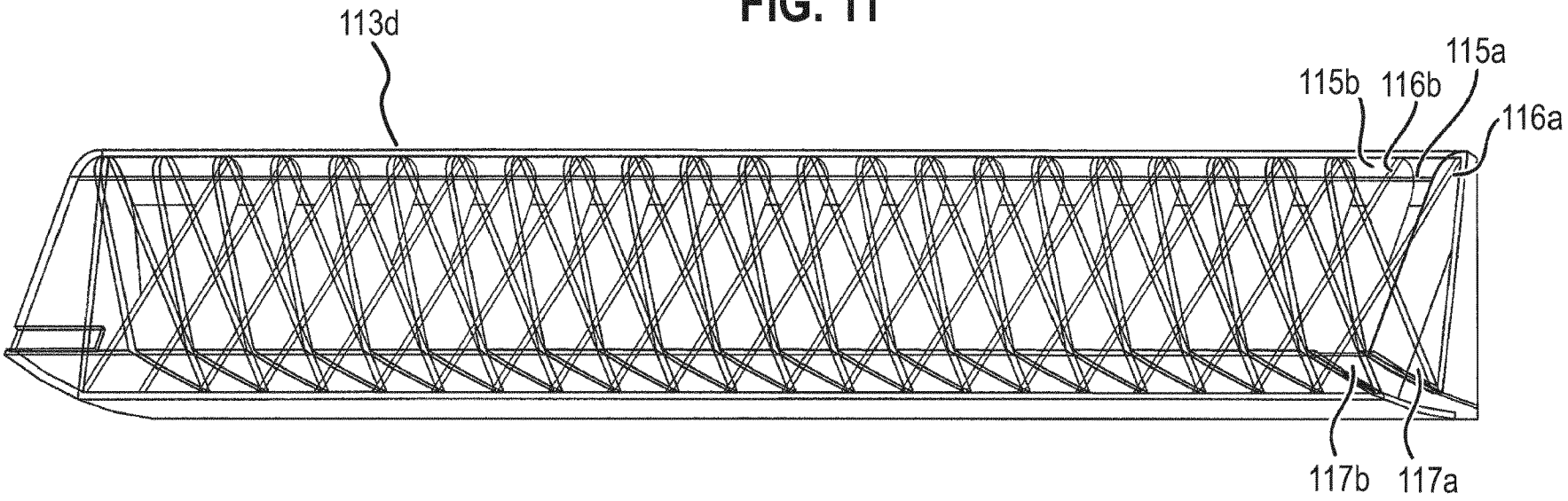
FIG. 11 illustrates an example of a paternoster configuration.
Figure 12:
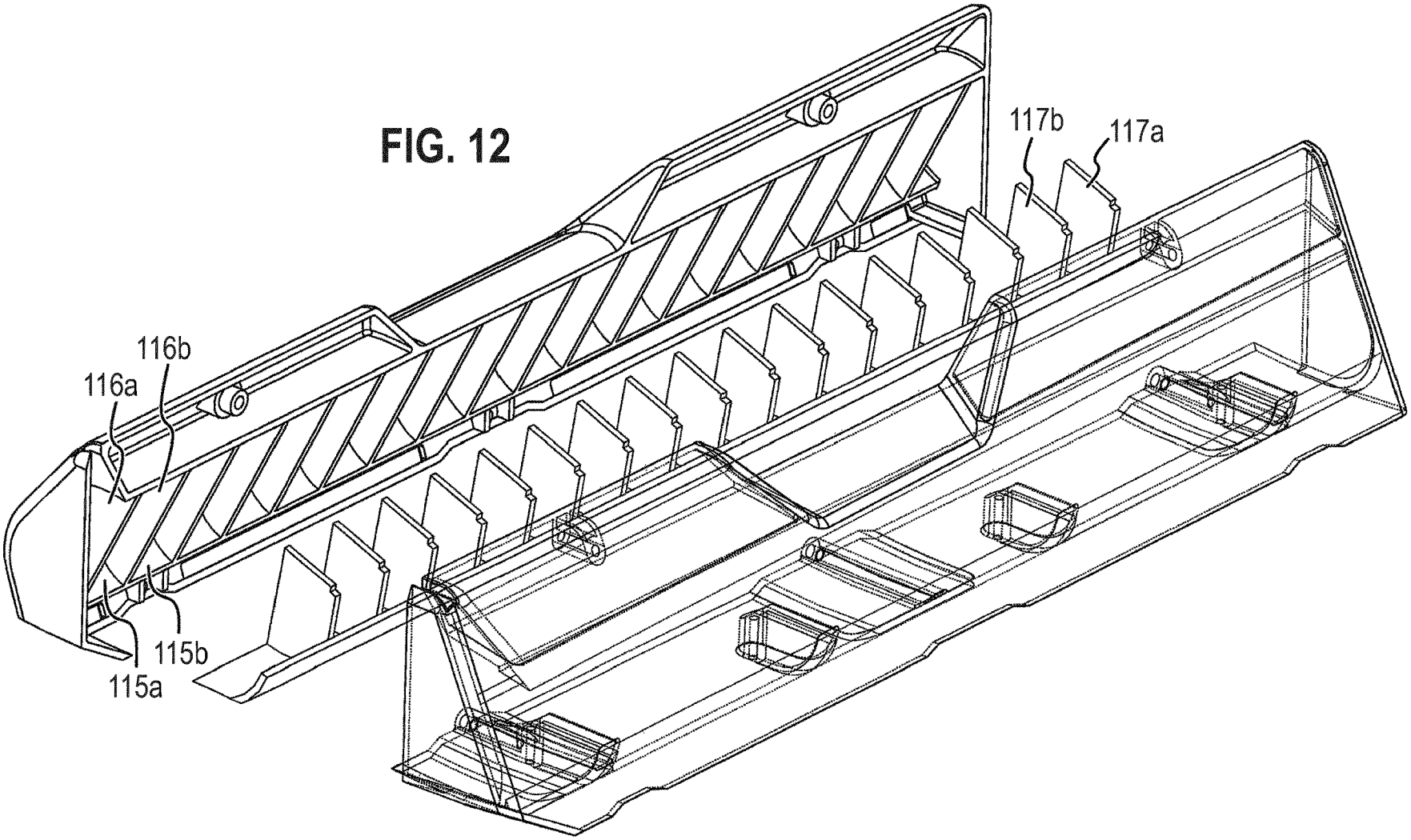
FIG. 12 shows the elongate protrusion in dissembled form.

FIGS. 11 and 12 do not show lifters of the present invention but illustrate an example of the paternoster configuration described herein. An elongate protrusion (113*d*) is shown having the paternoster configuration, wherein there is a first chain of open compartments (115*a, b*) formed by a first series of inclined, substantially parallel vanes (116*a, b*) and a second series of inclined, substantially parallel vanes (117*a, b*). FIG. 12 shows the elongate protrusion in dissembled form.

Figure 13:
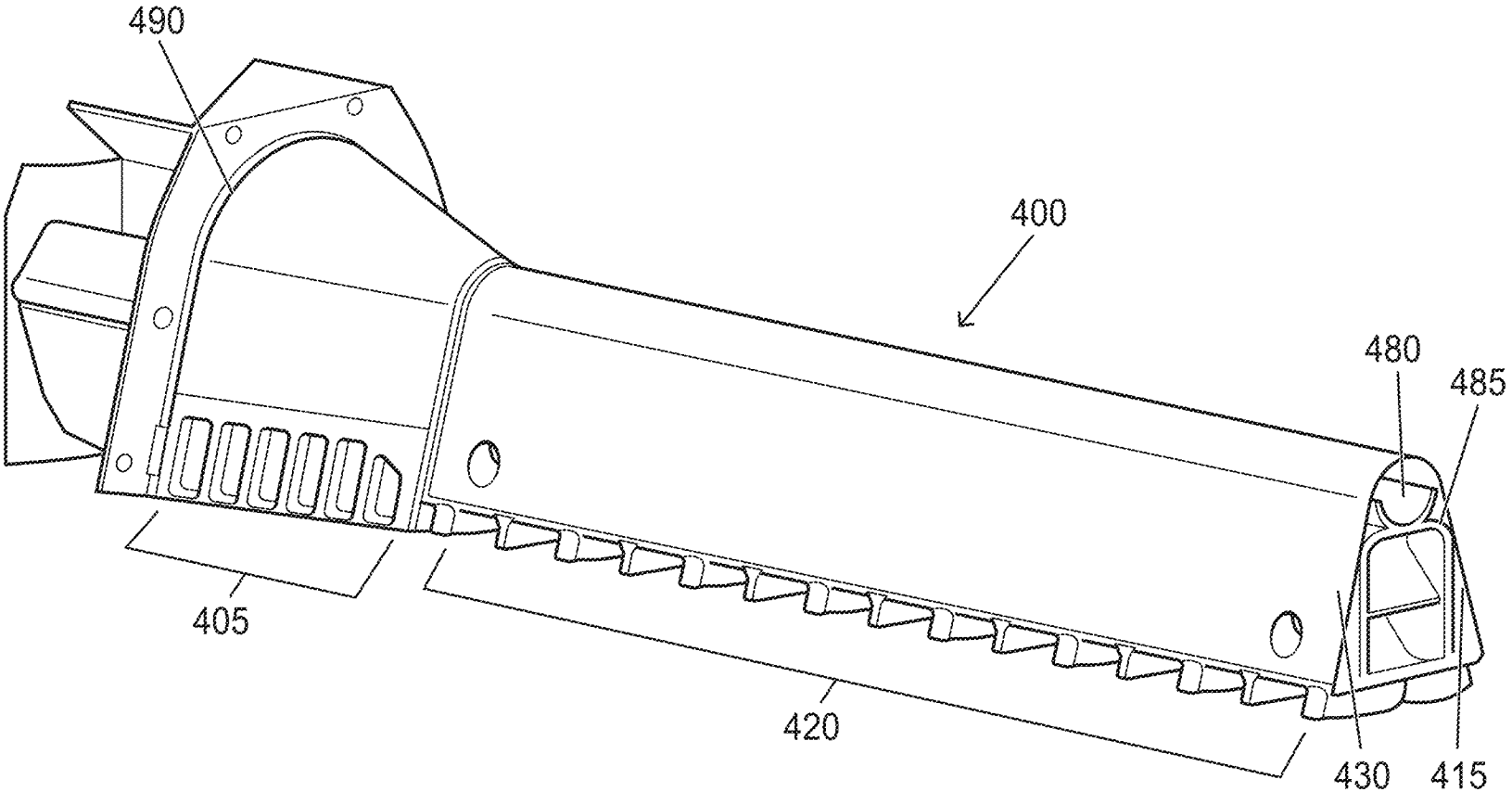
FIG. 13 shows a partial view of an alternative elongate protrusion or lifter.

FIG. 13 shows a partial view of an alternative elongate protrusion or lifter of the present invention. The lifter comprises a base portion for affixing the lifter to the interior surface of a drum (not shown). The lifter (400) has a first end (490) proximal to the end wall of a drum (not shown) and a second end (485) distal from the end wall of the drum (not shown).

The lifter has a first set of first collecting apertures (420) in a first side (430) of the lifter. Solid particulate material (not shown) that enters via the first set of first collecting apertures (420) follows a first type of first collecting flow path within the lifter (400). The lifter has a first set of second collecting apertures (not shown) in a second side (415) of the lifter. Solid particulate material (not shown) that enters via the first set of second collecting apertures follows a first type of second collecting flow path within the lifter (400). In the elongate protrusion of FIG. 13, the first type of first collecting flow path and the first type of second collecting flow path coextend for a portion of their length. The first and second types of first collecting flow paths may comprise any of the paths described herein, for example they may comprise a series of deflectors or an Archimedean screw. The lifter has an aperture (480) in which a tie bar can be located. The aperture (480) is located in the lifter at a radially inward position, proximal to the top portion of the lifter. The first and second types of first collecting flow paths are located radially outward of the tie bar aperture (480), i.e. distally from the centre of the drum.

The lifter also comprises on a first side (430) of the lifter a second set of first collecting apertures (405) which is located proximal to the first end (490) of the lifter. The second set of first collecting apertures (405) is positioned closer to the first end (490) of the lifter than the position of said first set of first collecting apertures (420). Each of the first collecting apertures in the second set of first collecting apertures (405) defines the start of a second type of first collecting flow path (not shown). As a drum comprising the lifter rotates in a first direction, solid particulate material in the interior of the drum can enter the second type of first collecting flow path inside the lifter via the second set of first collecting apertures (405). The solid particulate material follows the second type of first collecting flow path towards the storage means in the end wall of the drum.

On a second side (415) of the lifter opposite to the first side (430) of the lifter, the lifter comprises a second set of second collecting apertures (not shown). The second set of second collecting apertures connect to a second type of second collecting flow path. As the drum rotates in a second direction, which is the opposite rotational direction to the first direction, solid particulate material in the interior of the drum can enter the second type of second collecting flow path inside the lifter via the second set of second collecting apertures. The solid particulate material follows the second type of second collecting flow path towards the storage means in the end wall of the drum as the drum rotates. The second type of second collecting flow path may comprise an opposing configuration to the second type of first collecting flow path, e.g. the second type of second collecting flow path may comprise a flow path arranged as a mirror image of the second type of first collecting flow path. In the arrangement illustrated in FIG. 13, the second type of first collecting flow path and the second type of second collecting flow path are shorter and less tortuous than the first type of first collecting flow path and the first type of second collecting flow path.

Where the rotational axis of the drum is inclined relative to the horizontal direction such that solid particulate material is biased towards the end wall of the drum under the influence of gravity, the majority of the solid particulate material may enter the lifter (400) via the second set of first collecting apertures (405) and the second set of second collecting apertures compared to the that which enters via the first set of first collecting apertures (420) and the first set of second collecting apertures.

Figure 14:
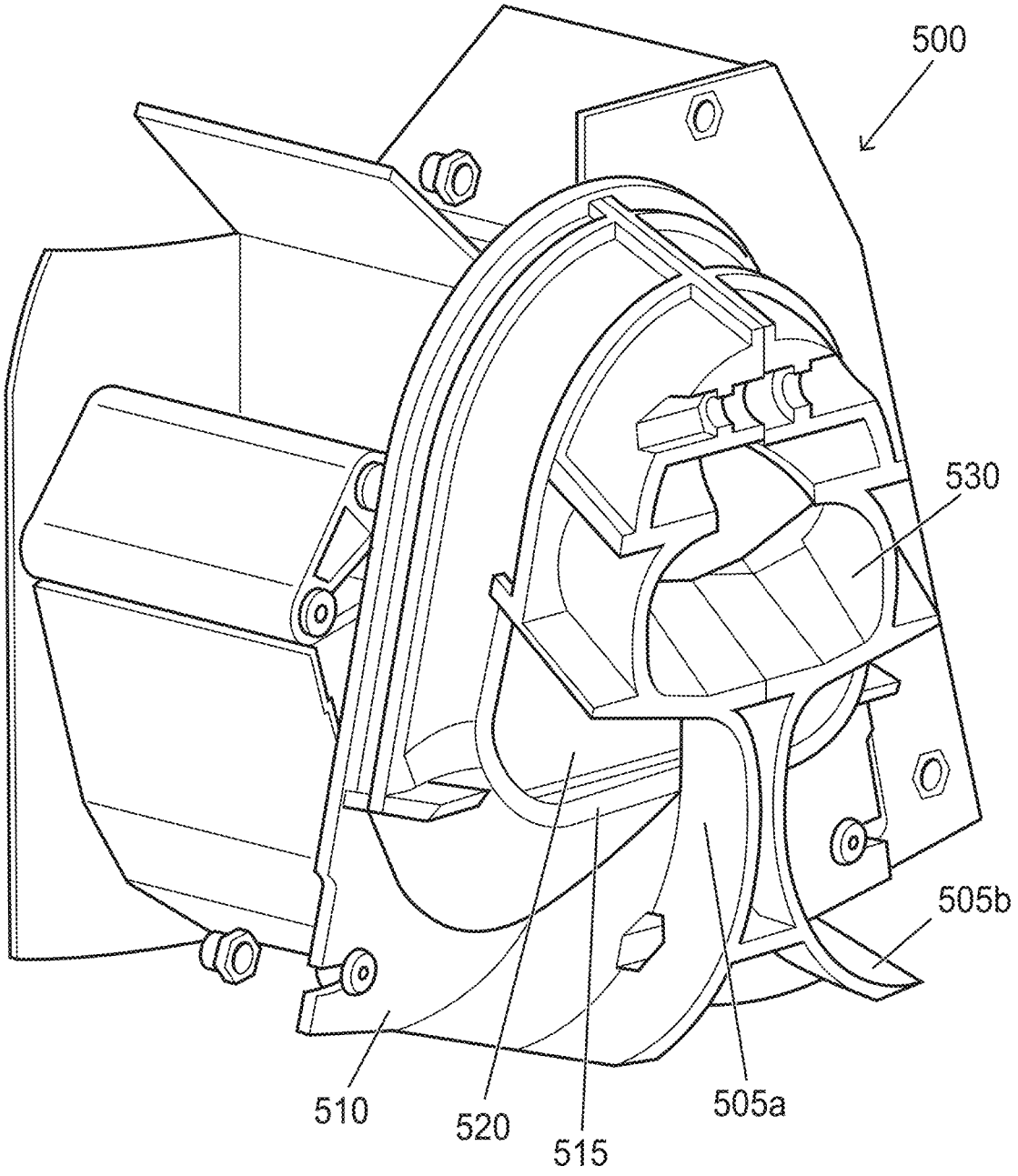
FIG. 14 shows a cut away view of a portion of the lifter of FIG. 13 proximal to the end wall of the drum.

Referring to FIG. 14, a cut away view of a portion (500) of the lifter of FIG. 13 proximal to the end wall of the drum (not shown) is shown. FIG. 14 shows first surfaces (505*a*, 505*b*), that are comprised in said second type of first collecting flow path and said second type of second collecting flow path. When the lifter is in a position at the bottom of the drum or close thereto, solid particulate material can be scooped up by one of the first surfaces (505*a*, 505*b*) depending on the direction of drum rotation and directed towards the storage means. The curvature of the first surface (505*a*, 505*b*) increases towards the end wall (510) of the drum and decreases away from the end wall (510) of the drum, this can bias solid particulate material axially towards the end wall as well as radially inwards. As the drum rotates, solid particulate material may be transferred from the first surface (505*a*, 505*b*) to a second surface (515). The second surface (515) may direct the solid particulate material into the storage means via an aperture (520) as the lifter moves towards the bottom of the drum during rotation of the drum. The second surface (515) may be planar or curved and may be angled radially outwards as shown in FIG. 14. The arrangement shown in FIG. 14 is such that the second type of first collecting flow path and the second type of second collecting flow path direct solid particulate material in a curved path generally moving the solid particulate material radially inwards. The second type of first collecting flow path and the second type of second collecting flow path then direct the solid particulate material axially and radially outwards towards the end wall of the drum.

At the end of the lifter proximal the end wall of the drum in the arrangement shown in FIG. 14, the second type of first collecting flow path and the second type of second collecting flow path are positioned radially outwards of the first type of first collecting flow path and the first type of second collecting flow path, that is, distal from the centre of the drum. The first type of first collecting flow path and the first type of second collecting flow path are directed radially inwards by an extended surface (530) adjacent to the aperture (520) which extends radially inwards to a greater extent than the preceding flow path. The extended surface (530) is adjacent to the aperture (520) into the storage means.

Figure 15:
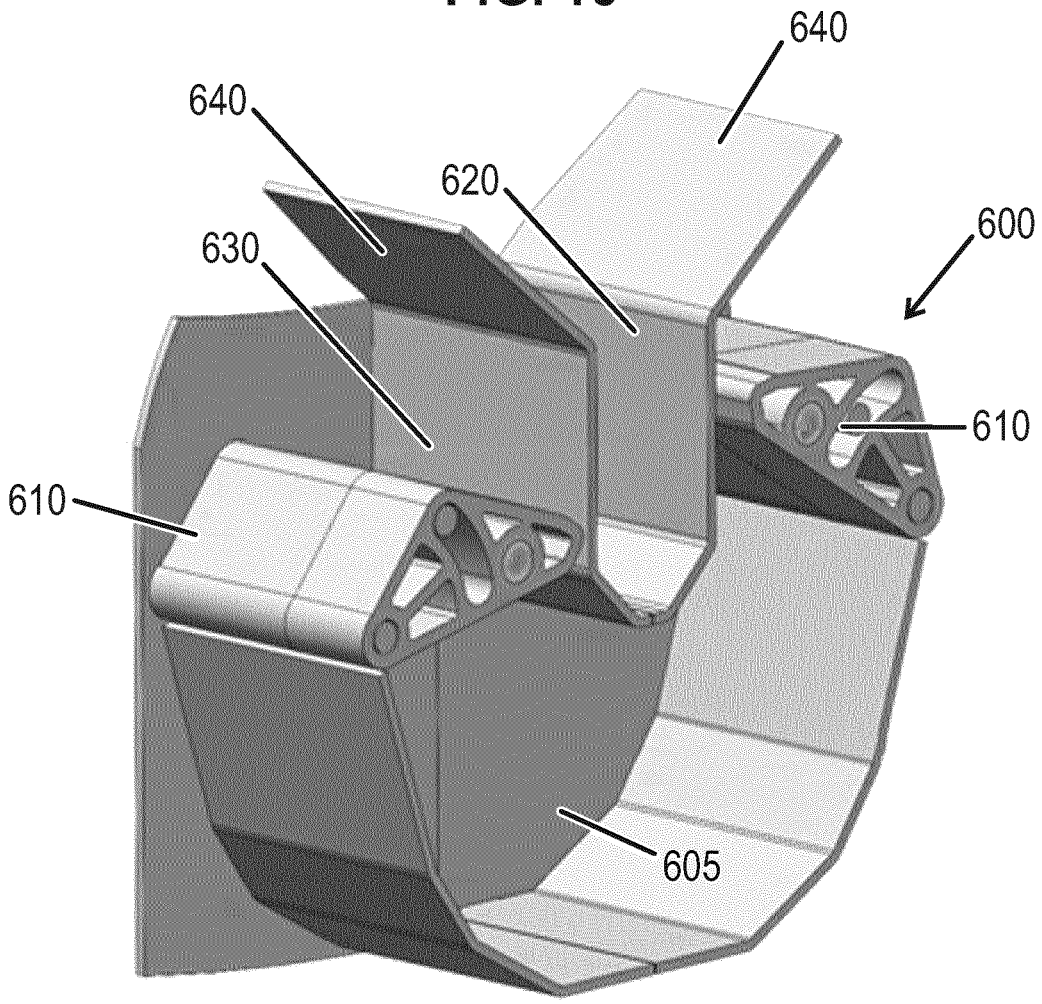
FIG. 15 shows a cut away section showing a collection chamber.

Referring to FIG. 15, a cut away section showing a collection chamber (600) is shown. The collection chamber (600) is useable with any elongate protrusion described herein. The collection chamber (600) is positioned within storage means at the end wall of the drum. The collection chamber (600) comprises a first volume (605) into which any of said first or said second collecting flow paths may direct solid particulate material. The collection chamber (600) comprises two gates (610) through which solid particulate material can exit the collection chamber (600) into the storage means. The gates (610) are operable under the influence of gravity as the drum rotates. The collection chamber (600) of FIG. 15 is shown in an orientation consistent with being positioned at the bottom of the drum. In this orientation, solid particulate material in the central volume (605) will reside at the base of the central volume away from the gates (610). With the drum rotated so the chamber (600) is at the top of the drum (i.e. in an inverted position from that shown in FIG. 14), the gates (610) will open allowing solid particle material to fall out of the central volume (605) under the influence of gravity into the storage means. As the drum continues to rotate, the gates (610) close again and solid particulate material is prevented from re-entering the central volume (605).

The collection chamber (600) comprises a shaped component (620) having an interior volume for receiving a tie bar (not shown). When the gates (610) are in a closed position, they can abut an outside surface (630) of the shaped component (620) in order to substantially seal the central volume (605). The shaped component (620) has two arms (640) that extend partially over the gates (610) and which can inhibit or prevent solid particulate material from accumulating on the surface of the gates (610) within the storage means. This arrangement has an advantage of preventing or alleviating the inhibition of the opening of the gates (610) as a result of accumulation of solid particulate material. This arrangement also has an advantage of allowing improved closure of the gates (610) by avoiding or reducing the accumulation of solid particulate material that would otherwise block or inhibit closure of the gates (610).

Figure 16:
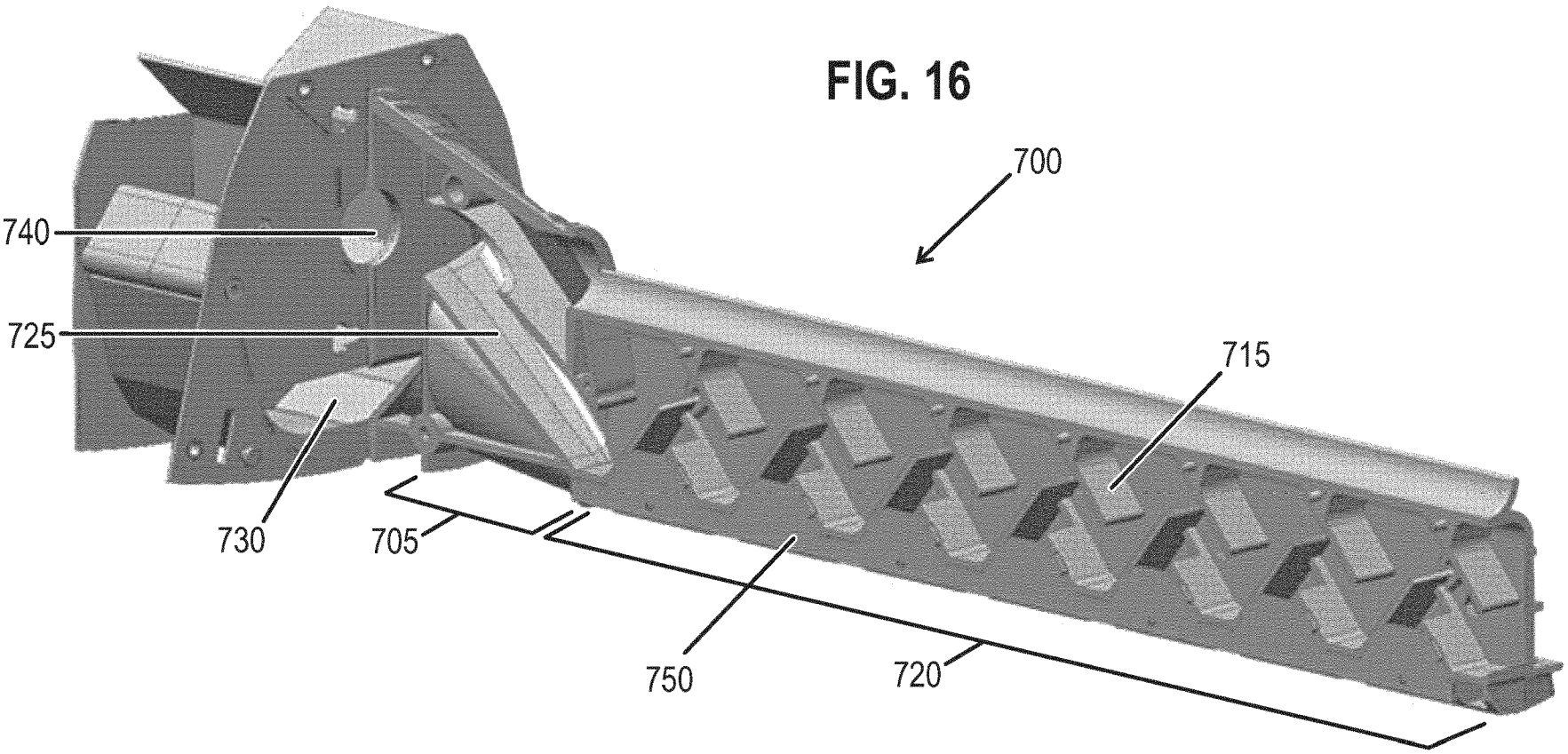
FIG. 16 shows a cut away section along a center line of an alternative elongate protrusion or lifter.

FIG. 16 shows a cut away section along a centreline of an alternative elongate protrusion or lifter (700). The lifter (700) comprises an aperture (740) for a tie bar. The aperture (740) aligns with the interior volume for receiving a tie bar of the shaped component (620) shown in FIG. 15. The lifter (700) comprises a first type of first collecting flow path and a first type of second collecting flow path that are partially but not completely coextensive. The first type of first collecting flow path originates from apertures (not shown) on a first side of the lifter positioned in a first portion (720) of the lifter, the first type of second collecting flow path originates from apertures (not shown) on a second side of the lifter in a first portion (720) of the lifter. The first type of first and first type of second collecting flow paths extend along the interior (715) of the first portion (720) of the lifter and terminate at an aperture (730) where solid particulate material enters the storage means. A coextensive portion of the first type of first and first type of second collecting flow path shown in FIG. 16 comprises an extended surface (725) prior to aperture (730).

The lifter (700) comprises a second type of first collecting flow path that originates from apertures (not shown) on a first side of the lifter positioned in a second portion (705) of the lifter, and a second type of second collecting flow path that originates from apertures (not shown) on a second side of the lifter in a second portion (705) of the lifter. The second type of first and second type of second collecting flow paths terminate at an aperture (730) where solid particulate material enters the storage means via the central volume (605) of a collection chamber (600) as shown in FIG. 15.

The lifter (700) comprises a barrier (750) that is positioned substantially centrally along the length of the lifter. The barrier (750) partially separates the two halves of the first portion (720) of the lifter. The barrier (750) functions to prevent solid particulate material that enters the apertures on one side of the first portion (720) of the lifter from passing straight through the lifter and exiting apertures on the other side of the first portion (720) of the lifter as the drum rotates.

The interior (715) of the first portion (720) of the lifter (700) comprises a series of deflectors that are in a herring-bone-type arrangement. Adjacent to the apertures (not shown) in the first portion (720) of the lifter there is a curved surface, or "ramp", (not shown) that urges solid particulate material somewhat radially inwards and more towards the central axis of rotation of the drum. Having a curved surface adjacent to the apertures can provide improved capture of the solid particulate material when the drum rotates at varying speeds. In addition, this arrangement helps prevent solid particulate material from exiting the aperture.

Features described herein in conjunction with a particular aspect or example of the disclosure are to be understood to be applicable to any other aspect, embodiment or example described herein unless incompatible therewith. As used herein, the words "a" or "an" are not limited to the singular but are understood to include a plurality, unless the context requires otherwise. The term "comprising" encompasses "including" as well as "consisting" and "consisting essentially of" e.g. a feature "comprising" X may consist exclusively of X or may include something additional e.g. X+Y.

The invention claimed is:

1. An apparatus for use in the treatment of substrates with a solid particulate material, said apparatus comprising a housing having mounted therein a rotatably mounted drum having an inner surface and an end wall and access means for introducing said substrates into said drum, wherein (a) said drum comprises storage means for storage of said solid particulate material; and (b) said drum comprises a first collecting flow path to facilitate flow of said solid particulate material from the interior of said drum to said storage means when said drum rotates in a first collecting direction, characterised in that said drum comprises a second collecting flow path to facilitate flow of said solid particulate material from the interior of said drum to said storage means when said drum rotates in a second collecting direction, wherein said second collecting direction is in the opposite rotational direction to said first collecting direction, and wherein said first collecting flow path and said second collecting flow path are different flow paths; and wherein said drum has a first elongate protrusion located on said inner surface of said drum wherein said first elongate protrusion extends in a direction away from said end wall, wherein said first elongate protrusion has an end proximal to the end wall and an end distal to the end wall, wherein said first elongate protrusion comprises said first collecting flow path and further comprises a first collecting aperture, wherein said first collecting aperture defines the start of said first collecting flow path; and wherein said first collecting aperture is disposed in a first side of said first elongate protrusion, wherein said first side of said first elongate protrusion is the leading side of said first elongate protrusion during rotation of the drum in said first collecting direction; and wherein said first elongate protrusion further comprises said second collecting flow path and a second collecting aperture, wherein said second collecting aperture defines the start of said second collecting flow path; and wherein said second collecting aperture is disposed in a second side of said first elongate protrusion, wherein said second side of said first elongate protrusion is the leading side of said first elongate protrusion during rotation of the drum in said second collecting direction.

2. The apparatus according to claim 1, wherein said first elongate protrusion comprises a plurality of said first collecting apertures disposed in said first side of said first elongate protrusion at a plurality of positions from the proximal end to the distal end thereof.

3. The apparatus according to claim 1, wherein said first elongate protrusion is configured to bias solid particulate material present inside said first collecting flow path towards the storage means during rotation of the drum in said first collecting direction and in said second collecting direction.

4. The apparatus according to claim 1, wherein said first elongate protrusion comprises a plurality of said second collecting apertures disposed in said second side of said first elongate protrusion at a plurality of positions from the proximal end to the distal end thereof.

5. The apparatus according to claim 1, wherein said first elongate protrusion is configured to bias solid particulate material present inside said second collecting flow path towards the storage means during rotation of the drum in said first collecting direction and in said second collecting direction.

6. The apparatus according to claim 1, wherein said first collecting flow path and said second collecting flow path are symmetrically arranged along the length of said first elongate protrusion.

7. The apparatus according to claim 1, wherein said first elongate protrusion comprises a barrier projecting from a base portion of said first elongate protrusion adjacent the inner surface of said drum, wherein said barrier extends at least partially towards a top portion of said first elongate protrusion, wherein said barrier at least partially separates said first collecting flow path and said second collecting flow path.

8. The apparatus according to claim 1, wherein said drum comprises a plurality of said first elongate protrusions.

9. The apparatus according to claim 1, wherein said drum further comprises a second elongate protrusion located on said inner surface of said drum, wherein said second elongate protrusion extends in a direction away from said end wall, wherein said second elongate protrusion has an end proximal to the end wall and an end distal to the end wall, wherein said second elongate protrusion comprises said second collecting flow path and a second collecting aperture, wherein said second collecting aperture defines the start of said second collecting flow path.

10. The apparatus according to claim 9, wherein said second collecting aperture is disposed in a first side of said second elongate protrusion, wherein said first side of said second elongate protrusion is the leading side of said second elongate protrusion during rotation of the drum in said second collecting direction.

11. The apparatus according to claim 10, wherein said second elongate protrusion comprises a plurality of said second collecting apertures disposed in said first side of said second elongate protrusion at a plurality of positions from the proximal end to the distal end thereof.

12. The apparatus according to claim 9, wherein said second elongate protrusion is configured to bias solid particulate material present inside said second collecting flow path towards the storage means during rotation of the drum in said first collecting direction and in said second collecting direction.

13. The apparatus according to claim 9, wherein said second elongate protrusion is spaced apart from said first elongate protrusion on said inner surface of said drum.

14. The apparatus according to claim 9, wherein said drum comprises a plurality of said first and/or said second elongate protrusions and wherein the total number of said first and second elongate protrusions comprised in the drum is two, three, four, five or six.

15. The apparatus according to claim 1, wherein said first collecting flow path and/or said second collecting flow path comprises a series of deflectors which are configured to urge said solid particulate material towards said storage means during rotation of said drum.

16. The apparatus according to claim 1, wherein said first collecting flow path and/or said second collecting flow path comprises a chain of open compartments which are configured to urge said solid particulate material towards said storage means during rotation of said drum.

17. The apparatus according to claim 1, wherein said first collecting flow path and/or said second collecting flow path is or comprises an Archimedean screw arrangement.

18. The apparatus according to claim 1, wherein one of said first or second collecting flow paths comprises a substantially clockwise path and the other of said first and second collecting flow paths comprises a substantially counter-clockwise path.

19. The apparatus according to claim 1, wherein movement of said solid particulate material between the interior of the drum and the storage means is actuated entirely by rotation of the drum.

20. The apparatus according to claim 1, wherein said storage means is or comprises at least one cavity located in the end wall of the drum.

21. The apparatus according to claim 1, wherein the storage means comprises 2, 3, 4, 5 or 6 compartments.

22. The apparatus according to claim 21 further comprising a delivery duct in fluid communication between said first collecting flow path and/or said second collecting flow path and a compartment of said storage means, wherein said delivery duct is configured to transfer said solid particulate material from said first collecting flow path and/or said second collecting flow path to said compartment.

23. The apparatus according to claim 22, wherein said delivery duct comprises at least one baffle to regulate the flow of solid particulate material from the delivery duct into said compartment.

24. The apparatus according to claim 22, wherein said delivery duct is located around a portion of the circumference of the end wall of the drum.

25. The apparatus according to claim 22, wherein said delivery duct comprises a first entry aperture and a first exit aperture, wherein the first entry aperture is in fluid communication with said first collecting flow path and/or said second collecting flow path and is configured such that solid particulate material is able to enter the delivery duct through said first entry aperture and pass through the delivery duct as the drum rotates in said first collecting direction before passing through the first exit aperture and into a compartment of the storage means.

26. The apparatus according to claim 25, wherein said delivery duct further comprises a second entry aperture and a second exit aperture, wherein the second entry aperture is in fluid communication with said first collecting flow path and/or said second collecting flow path and is configured such that solid particulate material is able to enter the delivery duct through the second entry aperture and pass through the delivery duct as the drum rotates in said second collecting direction before passing through the second exit aperture and into a compartment of the storage means.

27. The apparatus according to claim 26, wherein the delivery duct further comprises:

(a) a central portion comprising said first and second entry apertures;

(b) a first arm extending from said central portion in a first direction around the circumference of said end wall to a first end of said delivery duct; and (c) a second arm extending from said central portion in a second direction around the circumference of said end wall to a second end of said delivery duct, wherein said first exit aperture is adjacent said first end and said second exit aperture is adjacent said second end.

28. The apparatus according to claim 27, wherein said delivery duct comprises a first arrangement of one or more baffles configured to regulate the flow of solid particulate material that nears the first exit aperture of the delivery duct when said first exit aperture is below the horizontal plane bisecting the axis of drum rotation as the drum rotates in said first collecting direction, and wherein said first arrangement of one or more baffles is further configured to allow solid particulate material to pass through the first exit aperture and enter the compartment of the storage means when said compartment is oriented so as to reduce the amount of solid particulate material already in said compartment that is adjacent the point of entry into the compartment compared to the amount of solid particulate material adjacent the point of entry when said compartment is in other orientations during rotation of said drum.

29. The apparatus according to claim 1, wherein the storage means comprises multiple compartments located in the end wall of the drum, wherein each of the compartments is defined by a cavity bound by a first wall and a second wall which each extend outwards from the rotational axis of the drum towards the inner wall of the drum.

30. The apparatus according to claim 29, wherein each compartment is in fluid communication with its adjacent compartment or compartments such that solid particulate material, as well as any liquid medium, is able to pass from one compartment directly into an adjacent compartment during rotation of the drum and wherein fluid communication between adjacent compartments is effected by a communicating aperture in the wall between adjacent compartments.

31. The apparatus according to claim 1, wherein the storage means further comprises one or more perforations which have dimensions smaller than the dimensions of the solid particulate material so as to permit passage of fluids through said perforations into and out of the storage means.

32. The apparatus according to claim 1, wherein the inner surface of said drum comprises perforations which have dimensions smaller than the dimensions of the solid particulate material so as to permit passage of fluids into and out of said drum but to prevent egress of said solid particulate material.

33. The apparatus according to claim 1, wherein said drum has an opening at the opposite end of the drum to the end wall through which said substrates are introduced into said drum.

34. The apparatus according to claim 1, wherein said drum comprises a dispensing aperture and a dispensing flow path for facilitating flow of said solid particulate material from said storage means to the interior of said drum.

35. The apparatus according to claim 34, wherein said dispensing aperture is comprised in said end wall of said drum.

36. The apparatus according to claim 1, wherein the apparatus does not comprise a further storage means which is not attached to or integral with the drum, and/or wherein the apparatus does not comprise a pump for circulating said solid particulate material between the storage means and the interior of the drum.

37. The apparatus according to claim 1, wherein the apparatus does not comprise a pump for circulating said solid particulate material.

38. A method of treating a substrate, the method comprising agitating the substrate in an apparatus according to claim 1 with solid particulate material.

39. The method according to claim 38 wherein the solid particulate material is re-used in further treatment procedures according to the method.

40. The method according to claim 38 wherein the method is a method for treating multiple batches, wherein a batch comprises at least one substrate, the method comprising agitating a first batch with solid particulate material, wherein said method further comprises the steps of:

(a) collecting said solid particulate material in the storage means;

(b) agitating a second batch comprising at least one substrate with solid particulate material collected from step (a); and (c) optionally repeating steps (a) and (b) for subsequent batch(es) comprising at least one substrate.

41. The method according to claim 38 wherein the method comprises agitating the substrate with solid particulate material and a liquid medium.

42. The method according to claim 38 wherein the substrate is or comprises a textile.

43. The method according to claim 42 wherein the treating of said substrate is cleaning, coloration, bleaching, abrading or ageing, or other textile or garment finishing process.

44. The method according to claim 43 for cleaning a substrate wherein the substrate is a soiled substrate.

* * * * *